US012654907B2

(12) United States Patent
Bloom

(10) Patent No.: US 12,654,907 B2
(45) Date of Patent: Jun. 16, 2026

(54) CONTAINERS

(71) Applicant: Richard W. Bloom, New York, NY (US)

(72) Inventor: Richard W. Bloom, New York, NY (US)

( * ) Notice: Subject to any disclaimer, the term of this patent is extended or adjusted under 35 U.S.C. 154(b) by 0 days.

(21) Appl. No.: 17/507,161

(22) Filed: Oct. 21, 2021

(65) Prior Publication Data

US 2022/0041334 A1 Feb. 10, 2022

Related U.S. Application Data

(63) Continuation of application No. 15/268,409, filed on Sep. 16, 2016, now Pat. No. 11,155,384, which is a continuation-in-part of application No. PCT/US2015/020722, filed on Mar. 16, 2015.

(60) Provisional application No. 62/326,622, filed on Apr. 22, 2016, provisional application No. 61/968,618, filed on Mar. 21, 2014.

(51) Int. Cl.

| | |
|---|---|
| ***B65D 25/00*** | (2006.01) |
| ***A47G 19/02*** | (2006.01) |
| ***A47G 19/22*** | (2006.01) |
| ***B65D 3/24*** | (2006.01) |
| ***B65D 25/04*** | (2006.01) |
| *B65D 5/72* | (2006.01) |
| *B65D 17/28* | (2006.01) |

(52) U.S. Cl.

CPC ..... *B65D 25/04* (2013.01); *A47G 19/02* (2013.01); *A47G 19/2205* (2013.01); *B65D 3/24* (2013.01); *B65D 25/005* (2013.01); *B65D 5/725* (2013.01); *B65D 17/402* (2018.01)

(58) Field of Classification Search

CPC .. B65D 25/005; B65D 21/0233; B65D 51/28; B65D 17/402; B65D 5/542; B65D 5/705; B65D 5/725; B65D 47/261; B65D 47/263; B65D 47/265

USPC ..... 426/115; 222/142.2, 142.4, 142.5

See application file for complete search history.

(56) References Cited

U.S. PATENT DOCUMENTS 2,740,575 A 4/1956 Fontaine
2,812,882 A * 11/1957 Osaka ..... A47G 19/24 222/142.4
3,203,583 A 8/1965 Amberg
(Continued)

FOREIGN PATENT DOCUMENTS

EP 1350453 A1 10/2003
FR 903540 A * 10/1945
(Continued)

OTHER PUBLICATIONS

FR_1200914_translation.pdf (Year: 1959).*
(Continued)

*Primary Examiner* — Allan D Stevens
(74) *Attorney, Agent, or Firm* — DeWitt LLP; Brian R. Pollack, Esq

(57) ABSTRACT

Containers are provided herein of various shapes and sizes including, in some embodiments, containers with side access ports of custom configurations and shapes. The port may be shaped like a hammer or other shapes, and may, in some embodiments have a removable cover placed thereover. In further embodiments, multi-compartment containers are disclosed that may be provided with multiple compartments

8 Claims, 47 Drawing Sheets

(56) References Cited

U.S. PATENT DOCUMENTS

| | | | | | |
|---|---|---|---|---|---|
| 3,207,390 | A * | 9/1965 | Short | B65D 47/265 | 222/553 |
| 3,637,130 | A | 1/1972 | Farquhar | | |
| 3,767,087 | A * | 10/1973 | Shannon | B65D 83/06 | D7/596 |
| 3,964,642 | A * | 6/1976 | Lesh | A47G 19/24 | 222/142.4 |
| 4,464,552 | A | 8/1984 | River-Dixie | | |
| 4,518,639 | A | 5/1985 | Phillips | | |
| 4,583,667 | A * | 4/1986 | Fishman | B65D 47/263 | 222/142.6 |
| 4,624,383 | A | 11/1986 | Moore | | |
| 4,915,235 | A | 4/1990 | Roosa | | |
| 4,961,496 | A | 10/1990 | Focke et al. | | |
| 5,000,387 | A * | 3/1991 | Szuhay | A01C 7/02 | 239/374 |
| 5,464,150 | A | 11/1995 | Sanchez | | |
| 5,573,131 | A | 11/1996 | Berjis | | |
| 5,588,561 | A * | 12/1996 | Ness | A47G 19/02 | 206/217 |
| 5,775,570 | A | 7/1998 | Kim | | |
| 6,022,570 | A | 2/2000 | Richmond | | |
| 6,060,097 | A | 5/2000 | Grigoryan | | |
| 6,079,586 | A * | 6/2000 | Hanneman | B65D 81/3283 | 206/217 |
| 6,253,995 | B1 * | 7/2001 | Blok | B65D 81/3869 | 229/940 |
| 6,394,338 | B1 | 5/2002 | Sluder | | |
| 7,090,072 | B1 | 8/2006 | Elliott | | |
| 7,882,991 | B2 * | 2/2011 | Schechter | B65D 25/52 | 426/123 |
| D686,507 | S | 7/2013 | Zanini | | |
| 9,033,194 | B1 * | 5/2015 | Grabowski | B65D 83/04 | 222/568 |
| 9,469,459 | B2 * | 10/2016 | Strominger | B65D 21/0209 | |
| 10,543,955 | B1 * | 1/2020 | Turturro | B65D 5/724 | |
| 2003/0006633 | A1 * | 1/2003 | Clothier | A47C 1/12 | 297/180.12 |
| 2004/0124203 | A1 | 7/2004 | Phelps et al. | | |
| 2007/0131667 | A1 * | 6/2007 | Amato | B65D 81/3858 | 219/387 |
| 2012/0205372 | A1 | 8/2012 | Crye | | |
| 2013/0047558 | A1 | 2/2013 | Hogan | | |
| 2013/0075392 | A1 * | 3/2013 | Learn | B65D 5/5286 | 220/6 |
| 2014/0144910 | A1 | 5/2014 | Ueda | | |
| 2019/0283943 | A1 * | 9/2019 | Lee | B65D 81/3205 | |

FOREIGN PATENT DOCUMENTS

| | | | |
|---|---|---|---|
| FR | 1200914 | A * | 12/1959 |
| FR | 1499662 | A | 10/1967 |
| RU | 65874 | U1 | 8/2007 |
| WO | 2004/110898 | A1 | 12/2004 |

OTHER PUBLICATIONS

International Search Report mailed Sep. 3, 2015, for corresponding International Patent Application PCT/US2015/020722.

Written Opinion mailed Sep. 3, 2015, for corresponding International Patent Application PCT/US2015/020722.

International Preliminary Report on Patentability mailed Sep. 21, 2016, for corresponding International Patent Application PCT/US2015/020722.

* cited by examiner

CONTAINERS

CROSS-REFERENCE TO RELATED APPLICATIONS

The present patent application is a continuation of and claims the benefit of priority to U.S. patent application Ser. No. 15/268,409, filed Sep. 16, 2016, now U.S. Pat. No. 11,155,384, which in turn is a continuation-in-part of and claims the benefit of priority to International Application No. PCT/US2015/020722, filed Mar. 16, 2015, which in turn claims the benefit of priority to U.S. Provisional Patent Application Ser. No. 61/968,618, filed Mar. 21, 2014. The present patent application is a continuation of and claims the benefit of priority to U.S. patent application Ser. No. 15/268,409, filed Sep. 16, 2016, now U.S. Pat. No. 11,155,384, which in turn claims the benefit of priority to U.S. Provisional Patent Application Ser. No. 62/326,622, filed Apr. 22, 2016. Each of the aforementioned patent applications is incorporated by reference herein in its entirety for any purpose whatsoever.

BACKGROUND

Field of the Disclosure

The present disclosure is directed to containers, such as those for comestible (e.g., edible) substances, such as liquids and food products.

Description of Related Art

Myriad containers for food and beverages have been proposed. Many of these containers include more than one compartment. Nonetheless, there remains a need in the art for improved containers, such as for food packaging and the like. The present disclosure provides solutions for these and other needs.

SUMMARY

The purpose and advantages of the present disclosure will be set forth in and become apparent from the description that follows. Additional advantages of the disclosed embodiments will be realized and attained by the methods and systems particularly pointed out in the written description hereof, as well as from the appended drawings.

To achieve these and other advantages and in accordance with the purpose of the disclosure, as embodied herein, the disclosure includes improved containers, especially those for containing multiple comestible substances. In some implementations, the disclosed embodiments provides cups and other containers that allows users to eat and drink on the go with maximum convenience, keeping all contents within a unified container. From small snacks, to larger sandwiches or sliders, users can use their fingers to lift up or pull out items from the side openings or tops of these containers. Thus, users can enjoy their food and/or beverages while walking, driving or doing just about any activity. Advantageously, the disclosed embodiments can be configured to fit in to standard and oversize cup holders.

Various implementations of containers are provided having one or more elongate vertical openings defined in the side of the container allowing food to be contained effectively even without the use of compartment containers or adhesive cover strips, and facilitates economy of production. Some embodiments can be used for more specialized applications for specific food types, beverage types, or for use in different environments or circumstances. In some embodiments, adhesive cover strips (e.g., that are perforated or non-perforated) can be used to cover openings in the containers. Containers for the subdivided containers can also be used for embodiments described herein.

Thus, many implementations provide the user with the ability to hold both food and beverage items in one unified container. An illustrative container can be partitioned along a vertical direction to create two or more distinct vertically oriented compartments, or may contain only one compartment with no dividers. Some embodiments have an elongate vertical opening down the outer side of the food compartment which allows for quick and easy retrieval of food and snack items. The food can be pushed up with fingers and pulled out of a larger opening at the top portion of the cup. Some food can also be pulled out of the vertical opening.

In some embodiments, an adhesive strip or panel can also be used to cover the opening on the food side, or the container can be wrapped in plastic film or paper or foil. This strip is preferably removable and can prevent food or crumbs from falling out of the cup. In some embodiments, the user can peel the strip as far down (or up) as needed in order to access the food items. The containers can range in size from very small (e.g., 3 fl. Oz) to very large (e.g., 128 fl. oz).

The wider side opening at the top of the container, where provided, can range in proportion and shape. The dimensions of the containers and openings can be configured for specific food types. The top opening may be rectangular, square, oval, circular or any assortment of shapes and designs. The opening may also gradually emerge from the narrow vertical opening forming a V-shape. In some embodiments, the top opening can extend all the way to the top edge of the container, or can extend to just below the top of the cup, for example, allowing for a standard cup lid to securely fasten to the cup. Similarly, the vertical opening can extend all the way down to the bottom of the cup or may be limited in its extension to just above the bottom to allow food crumbs, liquid or other items to collect at the bottom of the cup. As will be appreciated, in various embodiments, the vertical divider/dividers that divide the compartments of the container may extend down the middle of the container symmetrically, or may extend downwardly in other non-symmetrical partition configurations and/or at an angle with respect to the vertical direction. The containers can be solid, or be provided with one or more vertical gaps dividing the compartments to permit the containers to stack.

In some embodiments, a thermal barrier may be inserted into the container, such as plate of insulating material. The thermal barrier can allow the contents of one compartment to remain warm or hot while the contents on the other side remain cool/cold, or vice-versa. The thermal barrier can be made of any suitable material, such as styrofoam, polystyrene, any other food contact approved plastic material, metal, or other suitable material. The disclosed embodiments of containers can similarly be made from insulating material such as foamed materials (e.g., foamed styrene), thin or thick plastics, or any other suitable material.

In some embodiments, compartment boxes can also be provided for containing food compartment sections. These boxes can allow the user to retrieve the food on a LIFO (last in first out) basis. The compartment boxes can allow the food to be separated and organized. These compartment boxes may also have sub-compartment dividers within them. The material used for these boxes can be paper or plastic, among other materials. The containers provided herein generally can be made from any suitable material (e.g., metal, paper, plastic, combinations thereof) and may be disposable or reusable.

The compartment boxes can also have simple hinges that can be used to attach or suspend the boxes to the top portion of the food compartment. These hinges can be useful for compartment boxes disposed in a cavity of the container near the bottom of the container, as containers that are stacked will have different volumes if the overall container is tapered. This permits the user the ability to easily consume the contents of each box in turn. An elevation platform may also be used for food quantities that may not fill the entire volume of the cup/container or for situations where the user is placing the cup in a standard cup holder and the bottom portion of the cup may not be easily accessible. The elevation platform is preferably configured to fit securely in the bottom of the food compartment. Similar to the compartment boxes, the elevation platforms may also be made of paper or plastic, and the like.

Elongate vertical compartments can be provided with shelves or shelf inserts to separate food items that would tend to stick together, such as pizza or the like. If a shelf insert is provided, it can be removable to permit easy access of food items through the top of the container. Any embodiment of a container herein can be made from paper, plastic, or any other suitable material.

In some embodiments, containers having modular compartments can be provided. These modular compartments can be different in height to allow for varying quantities of food and beverage. Modules can be fastened together and form a standard cup shape at the bottom in order to fit into standard cup holders, be held easily by hand or be placed securely on a surface. It will be further appreciated that the overall shapes of the containers herein may have horizontal cross sections of differing shapes or transitioning shapes (round, square, oval, undulating, rectangular, triangular and the like).

In one embodiment, a container for holding comestible substances is provided, including a container having a peripheral sidewall with an interior portion separated by one or more substantially vertical partitions to define a plurality of compartments in the container, wherein at least one of the compartments defines an access opening in the peripheral sidewall into the compartment.

In another embodiment, a container for holding comestible substances is provided having a peripheral generally vertical sidewall defining an interior portion, the generally vertical sidewall further defining an access opening therethrough. The access opening can be vertically oriented along the height of the container. If desired, the access opening can be narrow at the bottom of the container and wider at the top of the container. The access opening can be of substantially uniform width along the height of the container.

In some implementations, the container can include a plurality of vertically oriented access openings defined through the sidewall thereof. The plurality of vertically oriented access openings can be spaced apart from each other about a periphery of the container and/or along the height of the container. In some embodiments, the access opening can spiral around the container. If desired, the access opening can be at least partially, or completely, covered by a protective flap.

In some implementations, the container can further include a lid with a depression formed in for containing a comestible product, and still further include a comestible product disposed in the depression.

In some embodiments, the container can further include a comestible product inserted into the container, the comestible product being disposed within a packaging that occupies only a portion of the horizontal area of the container. The packaging can include a pull tab that extends to the top of the container to permit the packaging to be pulled up to the top of the container to permit its contents to be accessed. If desired, the container can include a thermal insert configured to occupy less than the full horizontal area of the container, such that the thermal insert cooperates with the container to define a second compartment within the container for holding a comestible product. If desired, the container can include an elevation platform disposed within a compartment of the container for elevating a comestible product within the compartment.

In some implementations, the width of the access opening can gradually widen toward the top of the container. The width of the access opening can be a narrower width along a lower portion of the container, and a wider width near the top of the container. The access opening can be hammer shaped or flag shaped. The access opening can have a rectangular horizontally oriented upper section connected to a narrower, rectangular lower section. If desired, the container can further include a removable covering disposed over the access opening. The access opening can be defined by perforations that are ruptured to create the access opening.

The disclosure further provides, a container for holding and dispensing comestible products defined by an outer container and an inner container disposed within the outer container, and a container insert that surrounds the inner container and urges against the outer container for holding the inner container in place with respect to the outer container, and further wherein the outer container defines an access opening in a wall of the outer container, wherein the inner container and access opening are separated by the container insert. The container insert can be formed from folded sheet material. The inner container and outer container can be made from sheet material. The sheet material can include at least one of paper material and plastic material.

The disclosure further provides a container including an outer cup and an inner cup, wherein the inner cup is held in place inside of the outer cup by way of a crescent shaped insert disposed between the inner cup and outer cup to create a volume between the inner cup and outer cup having a crescent shaped cross section.

The disclosure still further provides a prepackaged food item including any container as described herein, with at least one comestible item disposed in at least one of the compartments or interior portion, respectively, wherein the at least one comestible item is specially shaped to match the shape and size of the at least one compartment or interior portion such that the at least one comestible item can slide down along the walls of the at least one compartment or interior portion without flipping over.

It is to be understood that both the foregoing general description and the following detailed description are exemplary and are intended to provide further explanation of the embodiments disclosed herein. The accompanying drawings, which are incorporated in and constitute part of this specification, are included to illustrate and provide a further understanding of the method and system of the disclosure. Together with the description, the drawings serve to explain the principles of the disclosed embodiments.

BRIEF DESCRIPTION OF DRAWINGS

Accompanying the description drawings illustrating the disclosed embodiments, which represent non-limiting, examples and in which.

DETAILED DESCRIPTION OF THE DISCLOSED EMBODIMENTS

Reference will now be made in detail to the present preferred embodiments of the disclosure, examples of which are illustrated in the accompanying drawings. The method and corresponding steps of the disclosed embodiments will be described in conjunction with the detailed description of the system.

The disclosure provides containers and related methods for their use. The subject containers are particularly useful for so called "grab and go" packaging applications where one or more comestible (e.g., edible) items are desired to be combined in the same package. The present disclosure goes further and provides divided containers that can include liquid and solid materials, such as beverages and snacks, in the same "cup-shaped" container. Such a shape is advantageous as it is easy to hold while walking, and can fit into a cup holder in a vehicle.

For purposes of illustration, and not limitation, an exemplary embodiment of a container in accordance in the disclosure is provided in FIG. 1. Alternative embodiments of containers in accordance with the disclosure, or aspects thereof, are provided in FIGS. 2-29. It will be appreciated that while containers having a round horizontal cross section are illustrated, the containers may have any desired shaped cross-section, such as square, triangular, oval, etc. along all or a part of their vertical extent. Moreover, the containers can have flared or tapered walls that have a varying cross section along the height of the container, or can have straight walls resulting in cross sections that do not change along the height of the container. Moreover, the cross section of the container can experience sudden transitions in size, such as by stepped increases in diameter/lateral dimension. The containers can also taper as depicted, or can taper in the opposing direction (i.e., with angled vertical walls that converge with increasing container height).

Figure 1A:
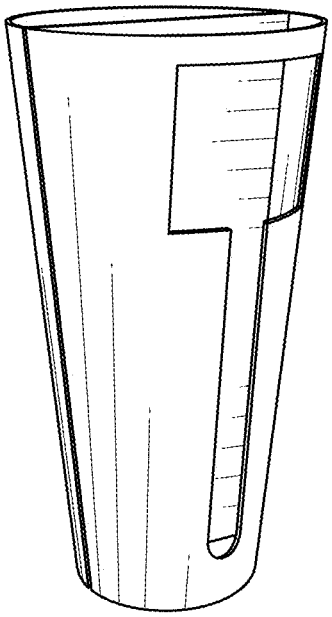
FIGS. 1A-1D are isometric views of a first exemplary embodiment of a container in accordance with the present disclosure.
Figure 1C:
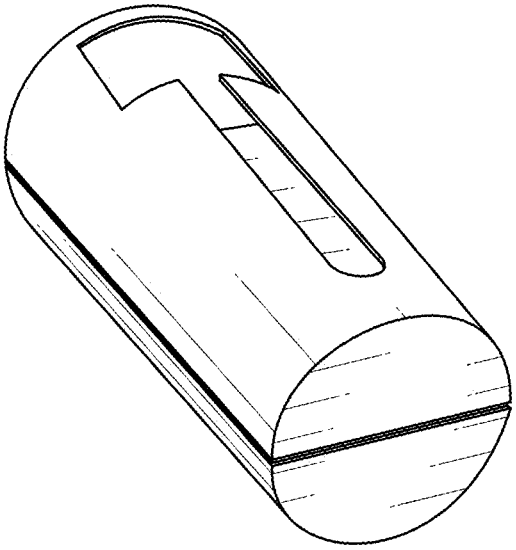
Figure 1B:
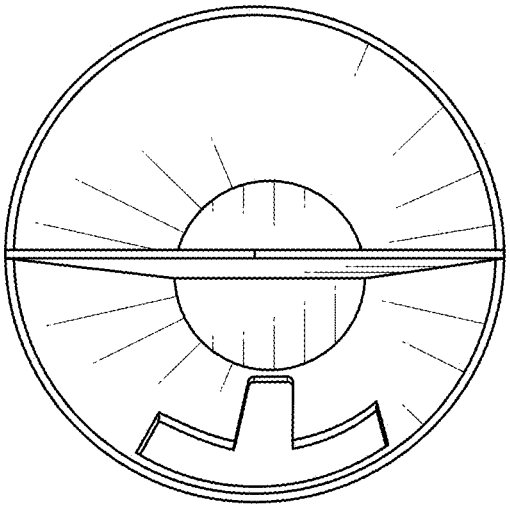
Figure 1D:
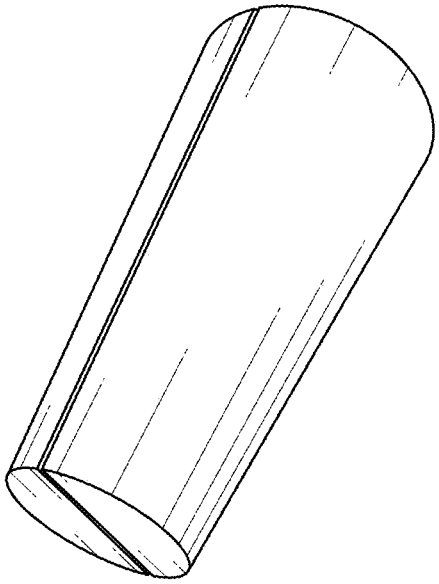
Figure 2A:
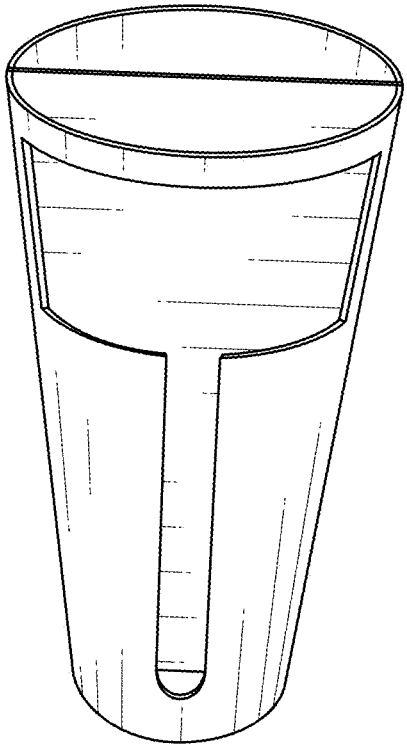
FIGS. 2A-2C are isometric views of a second exemplary embodiment of a container in accordance with the present disclosure.
Figure 2C:
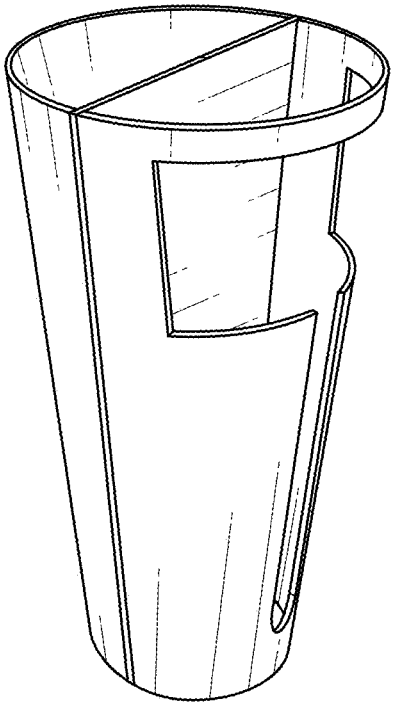
Figure 2B:
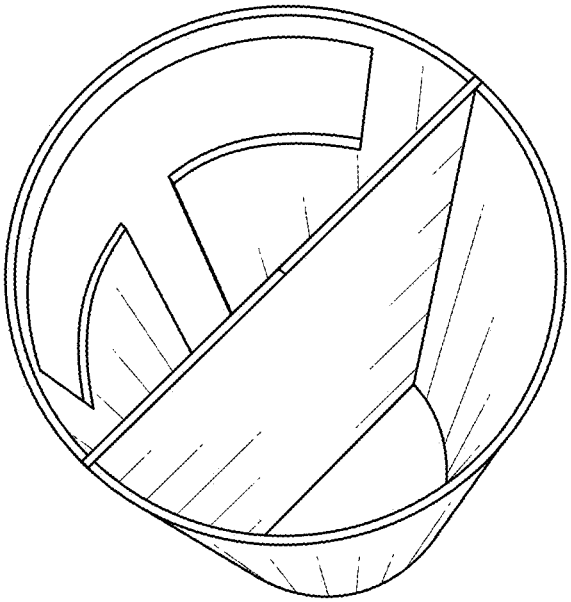
Figure 3A:
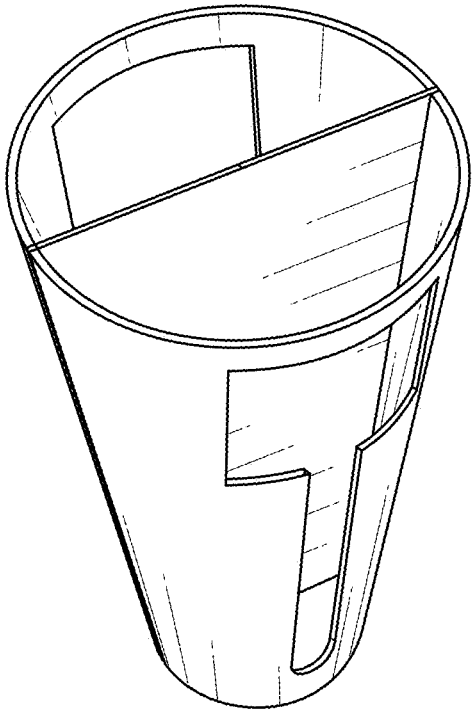
FIGS. 3A-3C are isometric views of a third exemplary embodiment of a container in accordance with the present disclosure.
Figure 3C:
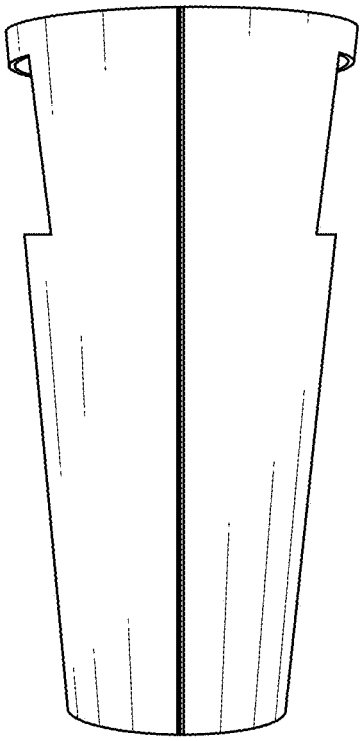
Figure 3B:
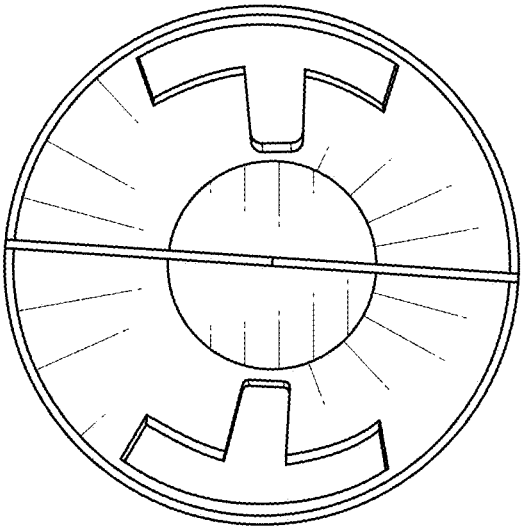

As illustrated in FIGS. 1A-1D, a container is provided that is generally cup-shaped, having a circular bottom that is parallel and connected to a circular top edge by a circumferential conical wall. As illustrated, a central vertical dividing wall is integrated with the container and divides the entirety of the container into two halves. It will be appreciated that the dividing wall in this or any other container disclosed herein can divide the container in any desired location, and may be off center, may be angled with respect to a vertical axis by any number of degrees in increments of about a half of a degree, and the like. One half of the container is closed except for a semicircular opening at the top of the container bounded by an upper edge of the dividing wall and half of the upper edge of the circumferential conical wall. The other half of the container includes a vertically oriented opening in the circumferential conical wall having a first narrow portion defined by two generally vertical edges that converge proximate the bottom of the container and then widens into a second, wider portion that is rectangular in shape, having two opposing bottom edges, two substantially vertical side edges and an upper horizontal edge, such that the opening is substantially "hammer" shaped. It will be appreciated that the relative sizes and widths of each of the lower and upper portions of the opening can be varied. In one embodiment, the half of the container with the opening is filled, for example, with a stack of chips (that may be semicircular in nature) and the other half is filled with a beverage. A peel-back foil or other paper layer or membrane (not shown) can be attached to the upper edges of the container to seal each compartment if the container is sold as a prepackaged comestible item. The lower portion of the opening in the side of the container is preferably large enough in width to accommodate a human finger for pushing snack foods up to the larger opening, where they can be pinched and extracted from the container. FIGS. 2A-2C illustrate a similar container wherein the upper portion of the opening is wider. It will be appreciated that the angular extent of any portion of the opening can vary from about ten degrees to about 270 degrees in one angle increments. FIG. 3 illustrates a version of a container having two "hammer" shaped openings. As will be appreciated, the angular extent of any portion of either opening can vary from about ten degrees to about 180 degrees in one angle increments.

Figure 4A:
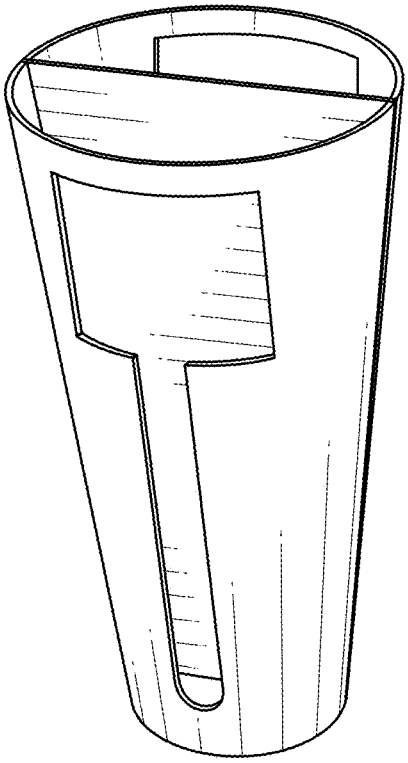
FIGS. 4A-4C are isometric views of a fourth exemplary embodiment of a container in accordance with the present disclosure.
Figure 4C:
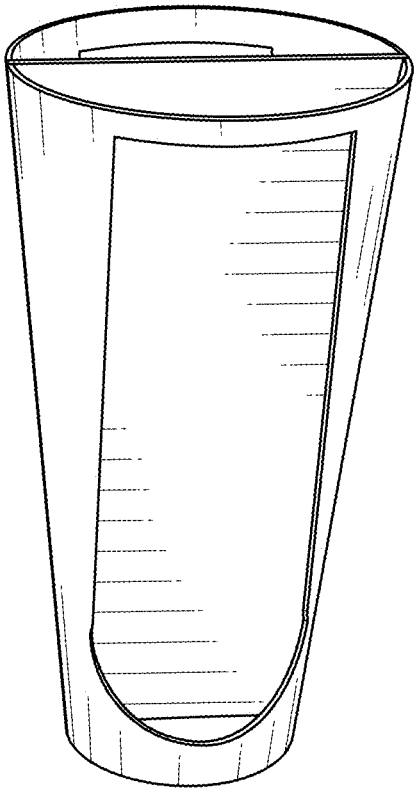
Figure 4B:
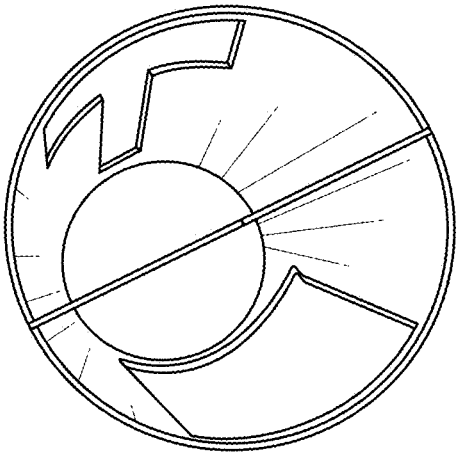

FIGS. 4A-4C illustrate yet a further embodiment wherein a divided container is provided having one "hammer" shaped opening and a second opening having a relatively constant width defined by generally parallel side edges connected at the top by a horizontal edge and at the bottom by a curved edge that curves in two planes (the conical plane of the sidewall, and the horizontal plane.

Figure 5A:
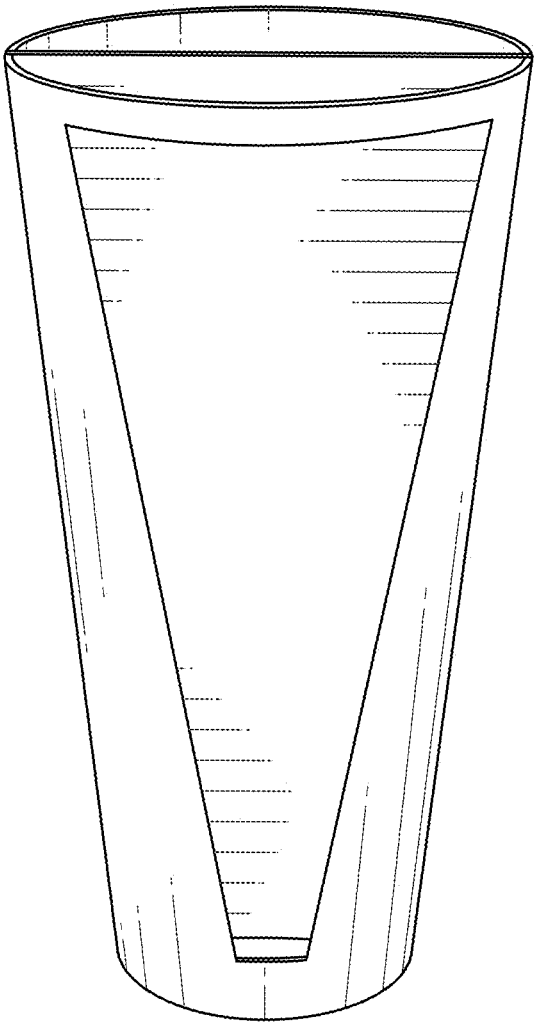
FIGS. 5A-5B are isometric views of a fifth exemplary embodiment of a container in accordance with the present disclosure.
Figure 5B:
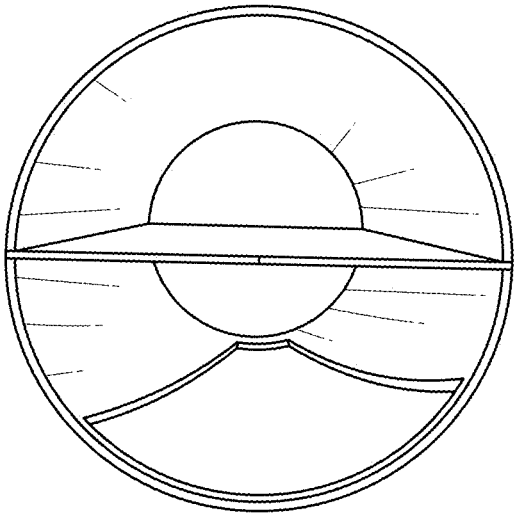

FIGS. 5A-5B illustrate a further embodiment of a divided container having one closed portion suitable for holding a beverage as in FIGS. 1-2, and with a second portion with an open sidewall having an opening that is generally wedge or substantially triangularly shaped, the opening having a steadily increasing angular extent along a direction from the bottom of the container toward the top of the container. The opening, as illustrated, is defined by two diverging straight side edges connected at the top by a first horizontal edge and at the bottom by a second horizontal edge.

Figure 6A:
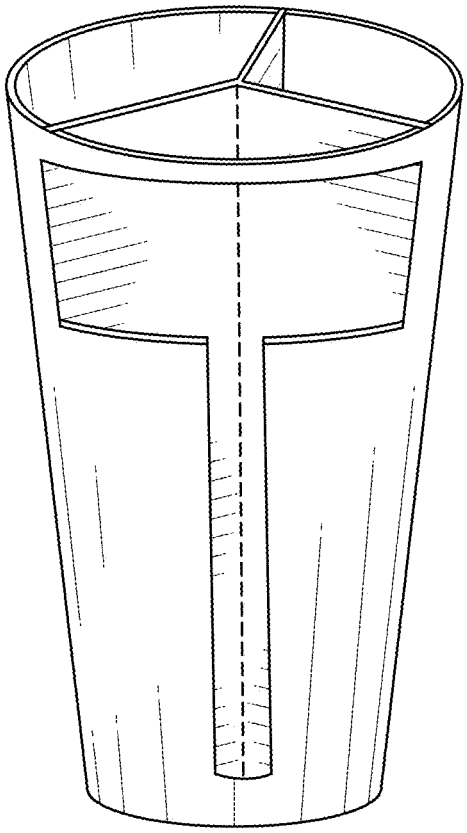
FIGS. 6A-6C are isometric views of sixth, seventh and eighth exemplary embodiments of a container in accordance with the present disclosure.

FIG. 6A illustrates another embodiment of a divided container having three compartments separated by a three walled vertical divider that may have an upper edge intersecting the upper outer peripheral edge of the container. It will be appreciated that the angular extent of each of the three compartments can be varied, such as in any increment of one degree, and that the intersection point of the three walls of the divider may be located at any point within the cup, rather than being at the center. The container is depicted having a hammer shaped opening in the face of one of the compartments. It will be appreciated that any of the compartments can have one or more openings through an exterior wall thereof of any desired shape or size.

Figure 6B:
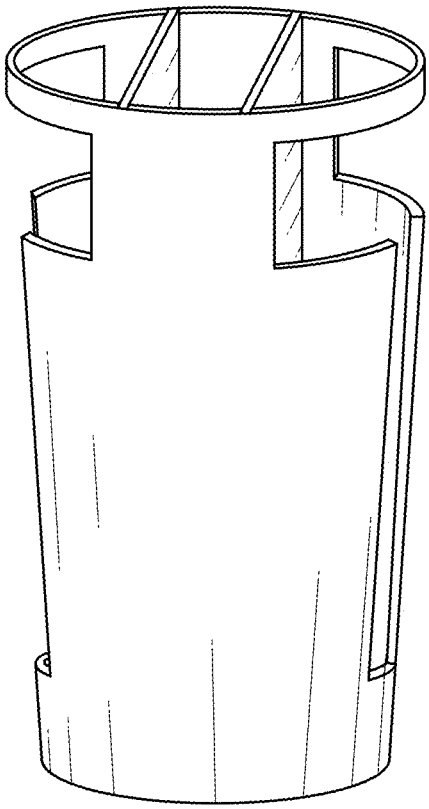

FIG. 6B illustrates a container similar in general outer shape to the other embodiments, but having two substantially spaced apart parallel dividers having lower edges joined to the bottom surface of the container, vertically oriented side edges attached to the sides of the container and upper edges that are substantially flush with an upper perimeter of the container. As depicted, the central compartment defined between the dividers is fluid tight and suitable for containing a liquid or quasi-liquid material, and the side compartments include "hammer" shaped openings similar to other embodiments disclosed herein.

Figure 6C:
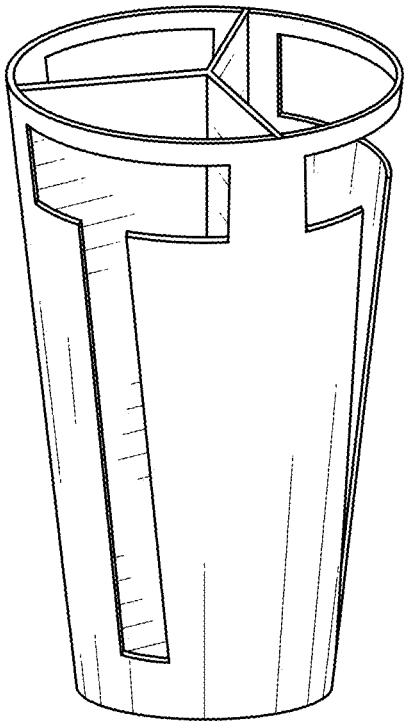

FIG. 6C is a further variation wherein a three panel divider is incorporated into the container, dividing the volume of the container into three substantially equal volumes. Each volume is provided with a "hammer" shaped opening. It will be appreciated that the angular extent of each of the three compartments can be varied, such as in any increment of one degree, and that the intersection point of the three walls of the divider may be located at any point within the cup, rather than being at the center. The container is depicted having a hammer shaped opening in the face of one of the compartments. It will be appreciated that any of the compartments can have one or more openings through an exterior wall thereof of any desired shape or size.

Figure 7A:
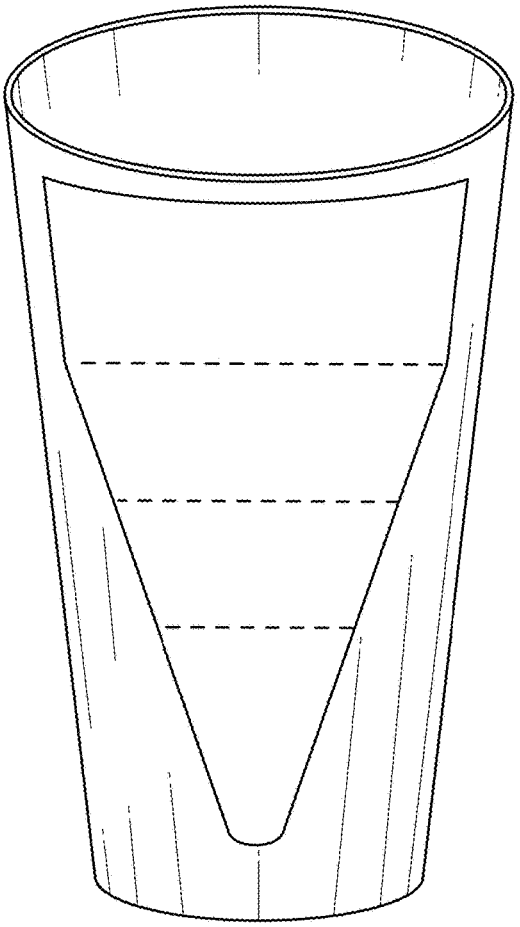
FIGS. 7A-7B are isometric views of a ninth exemplary embodiment of a container in accordance with the present disclosure.
Figure 7B:
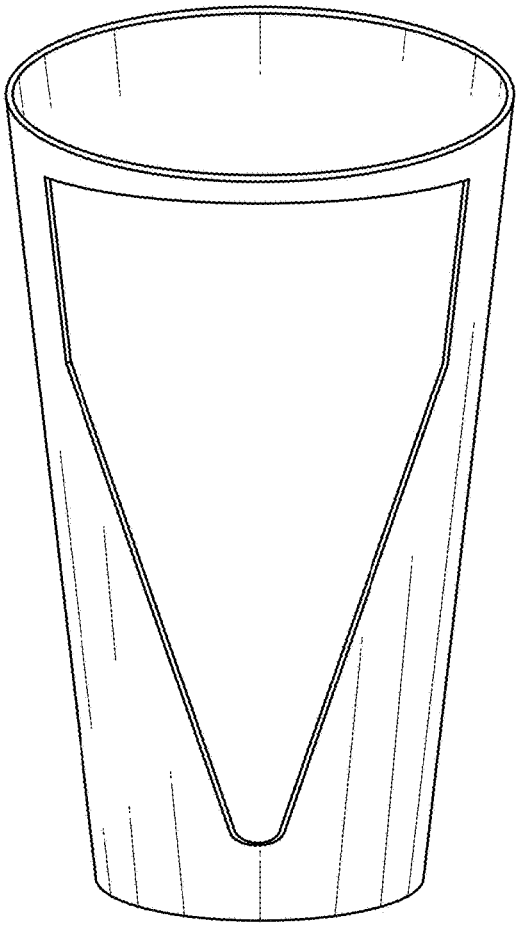
Figure 8A:
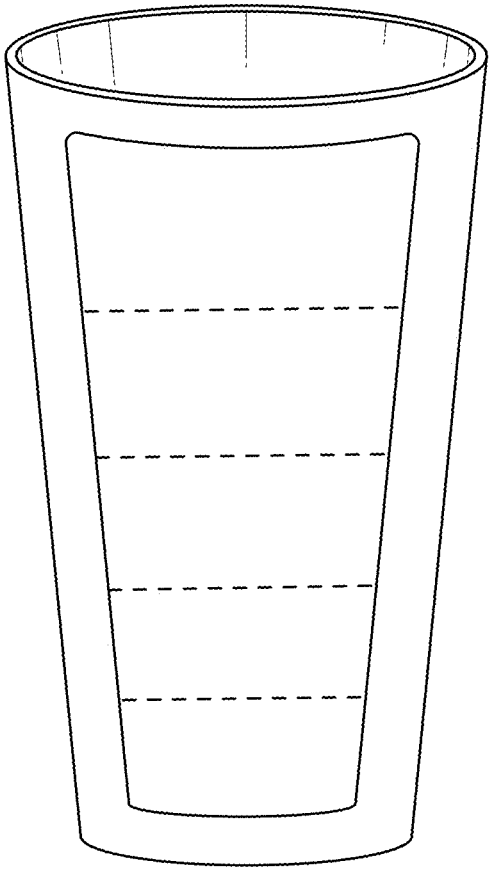
FIGS. 8A-8B are isometric views of a tenth exemplary embodiment of a container in accordance with the present disclosure.
Figure 8B:
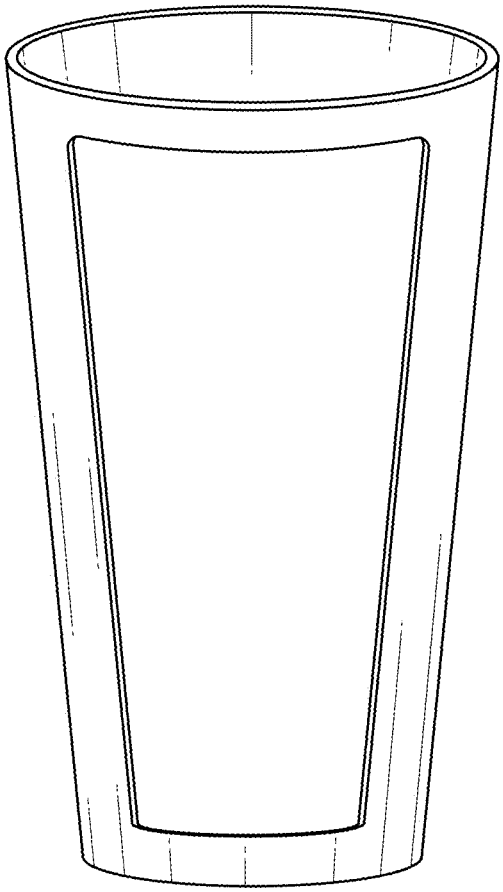

FIGS. 7A-7B are illustrations of a container having a removable panel on the exterior thereof and the container with the removable panel removed, respectively. The container can have any desired number of interior compartments as described with respect to other embodiments depicted herein. The container, as illustrated, has a wedge-shaped opening defined by two lower tapering edges that meet at the bottom of the opening that transition upwardly at inflection points into two substantially vertical edges that are joined at their top extremities by a horizontal edge. FIGS. 8A-8B illustrate an embodiment that is otherwise identical to the embodiment of FIGS. 7A-7B, but that has a substantially rectangular opening instead.

Figure 9A:
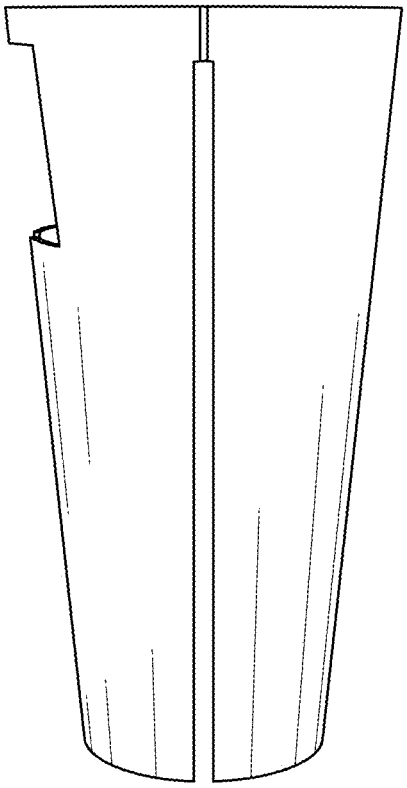
FIGS. 9A-9B are isometric views of eleventh and twelfth exemplary embodiments of a container in accordance with the present disclosure.
Figure 9B:
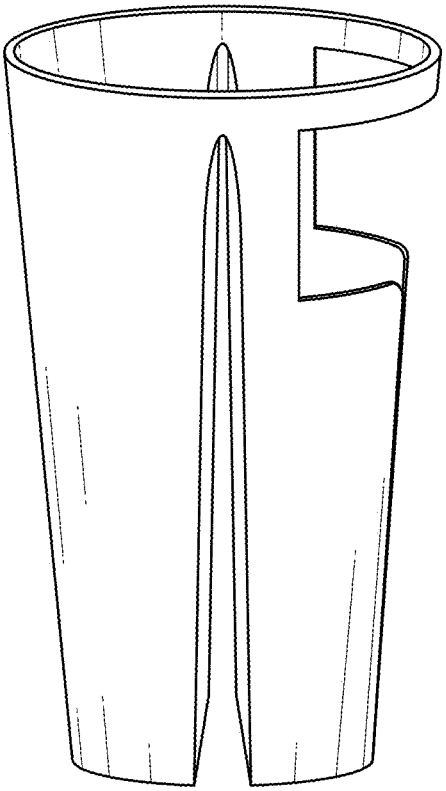

FIGS. 9A-9B illustrate examples of multi-compartment stackable containers. These containers are divided in half, but the divider actually constitutes two parallel walls, such that each division actually has its own peripheral wall having a semicircular horizontal cross section until a point where the two parallel walls meet at the top to form an apex. A gap is defined between the two parallel walls, that forms the structure to permit stacking of multiple containers that are similarly configured. FIG. 30 illustrate a similar embodiment, and FIGS. 31 A-F illustrate a four compartment version of a stackable container, having two compartments with side openings, and two compartments without them, wherein the four compartments are separated by intersecting partition walls that form a vertical gap having an "X"-shaped horizontal cross section to permit nested stacking of similar containers.

Figure 10:
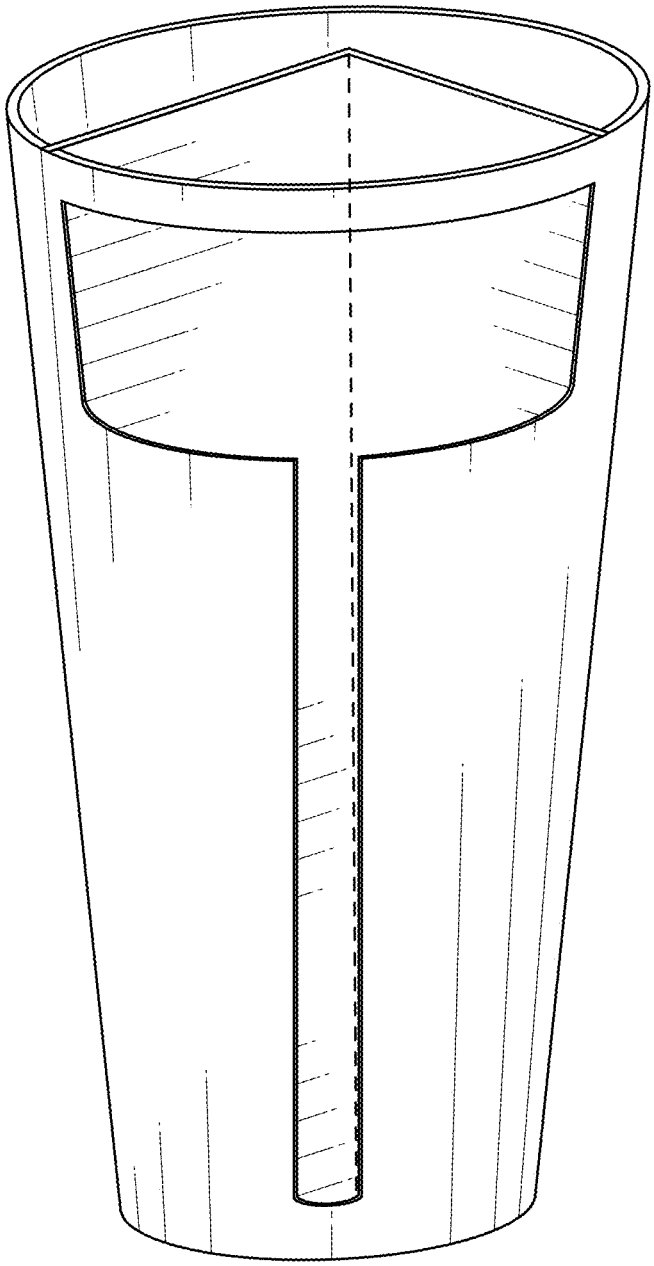
FIG. 10 is an isometric view of a thirteenth exemplary embodiment of a container in accordance with the present disclosure.
Figure 11:
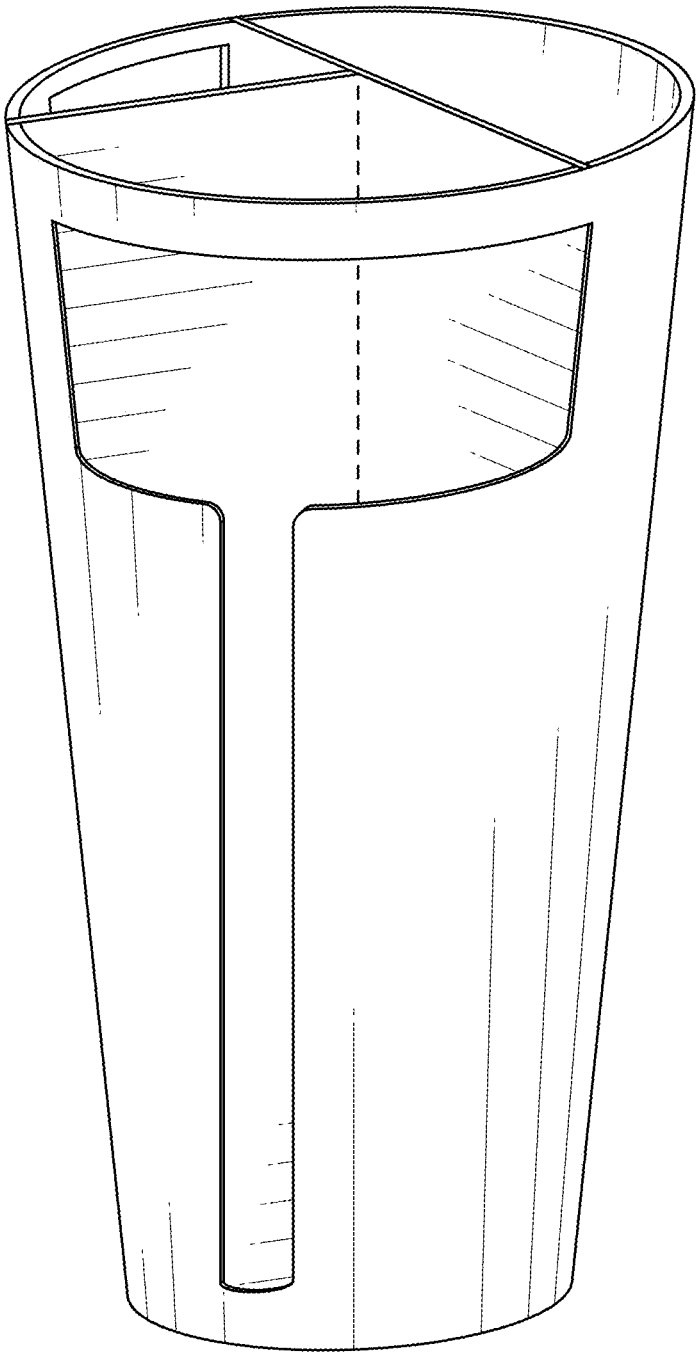
FIG. 11 is an isometric view of a fourteenth exemplary embodiment of a container in accordance with the present disclosure.
Figure 12:
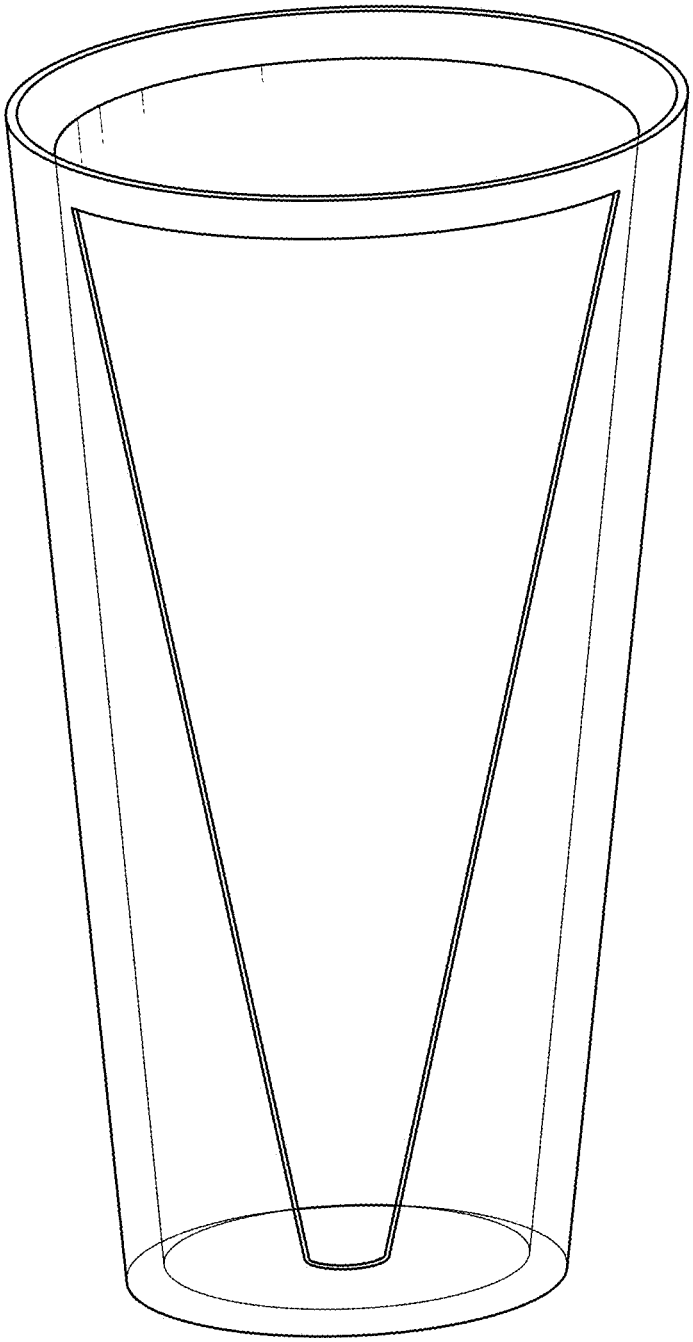
FIG. 12 is an isometric view of a fifteenth exemplary embodiment of a container in accordance with the present disclosure.

The embodiment of FIG. 10 includes a variation wherein the dividing wall has a "V"-shaped cross section that creates a larger compartment for a beverage and a smaller compartment with an opening in the exterior wall. It will be appreciated that the angular separation of the walls of the V-shaped dividing wall can be varied as desired, for example, from about thirty degrees to about three hundred degrees, in any increment of about one degree. FIG. 11 illustrates a further variation of a container having three compartments divided by a wall having three radial extensions, wherein two of the compartments are configured with exterior openings suitable for food items and a third compartment without such an opening, such as for beverage items. FIG. 12 illustrates a two compartment container including two substantially concentric chambers, wherein one of the compartments has a substantially circular cross section partially surrounded by a compartment having a crescent-shaped cross section. The "inner" compartment has an exterior surface defining an opening therethrough, and the crescent-shaped quasi-annular compartment does not include such an opening. As will be appreciated, the arrangement can be reversed wherein the annular compartment has an opening and the round one does not. Finally, it is possible for both or neither compartment to be provided with such an opening.

Figure 13:
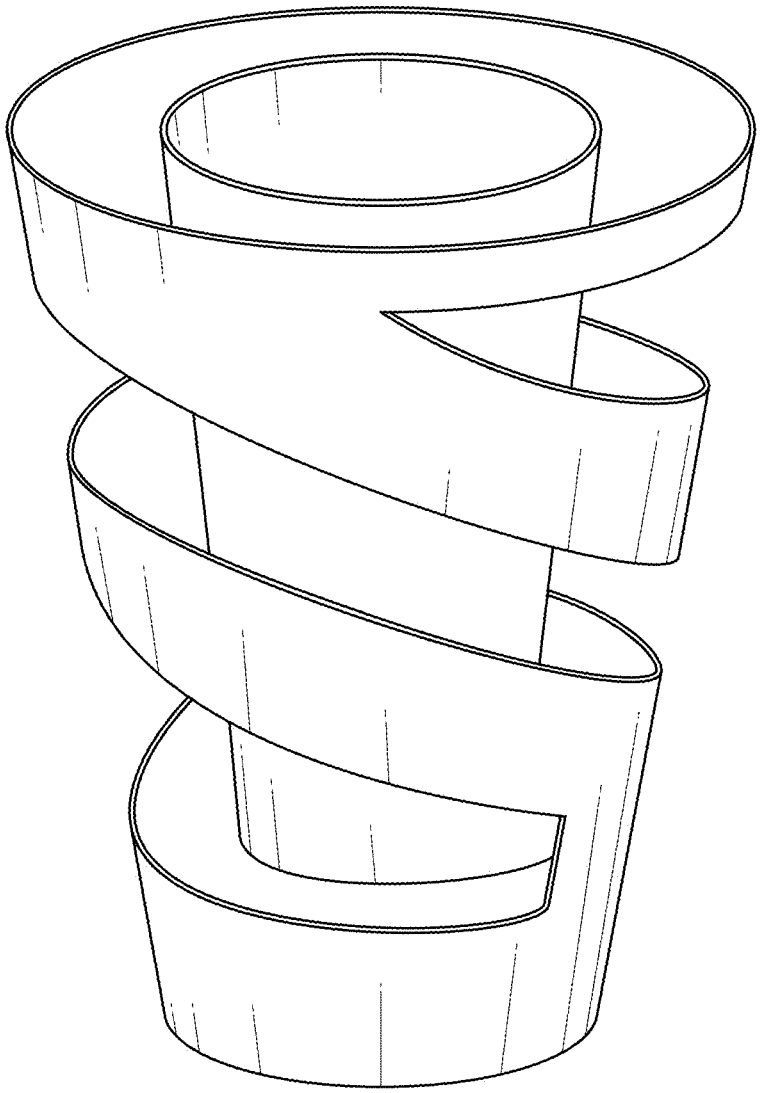
FIG. 13 is an isometric view of a sixteenth exemplary embodiment of a container in accordance with the present disclosure.

FIG. 13 illustrates a further embodiment of a container including an inner container disposed within and surrounded by a spiral-shaped outer container. As illustrated, the inner container is shaped like a tapered cylinder, and the outer container defines a corkscrew or spline-shaped ramp that winds around the inner container. The ramp can be continuous or stepped, as desired, to permit foodstuffs (e.g., donut holes, sushi) to be disposed on the ramp, surrounding the inner container.

Figure 14:
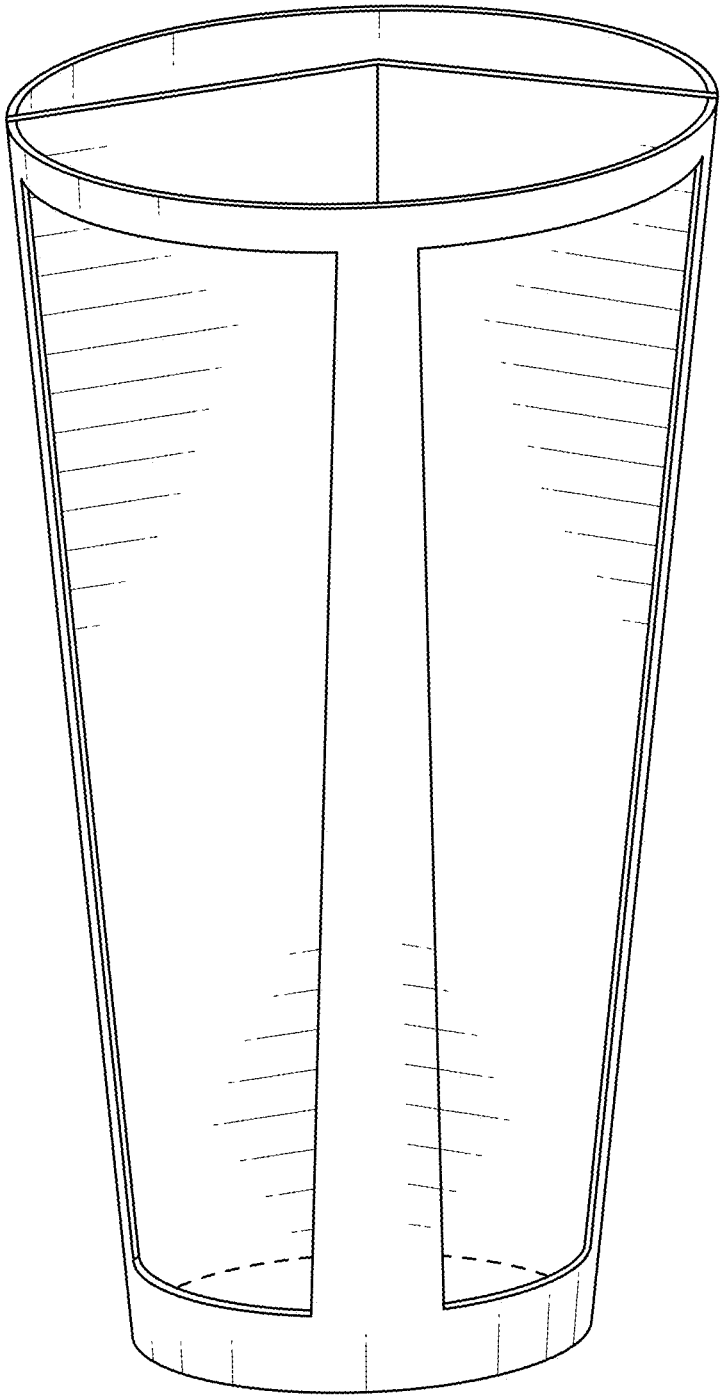
FIG. 14 is an isometric view of a seventeenth exemplary embodiment of a container in accordance with the present disclosure.
Figure 15:
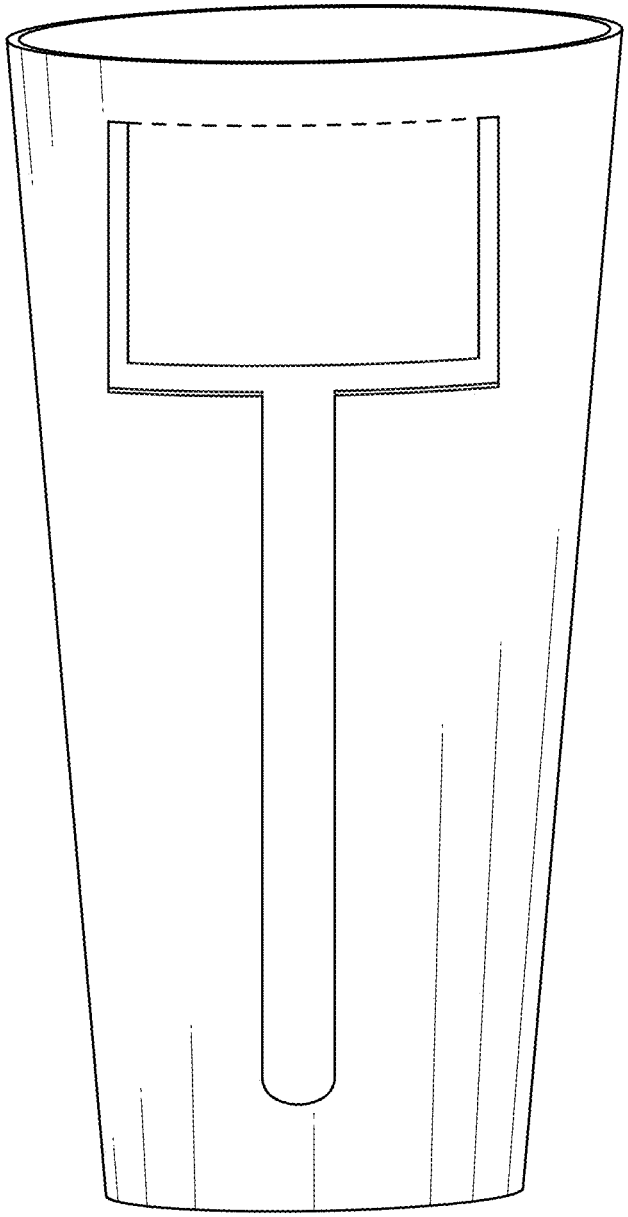
FIG. 15 is an isometric view of an eighteenth exemplary embodiment of a container in accordance with the present disclosure.
Figure 16:
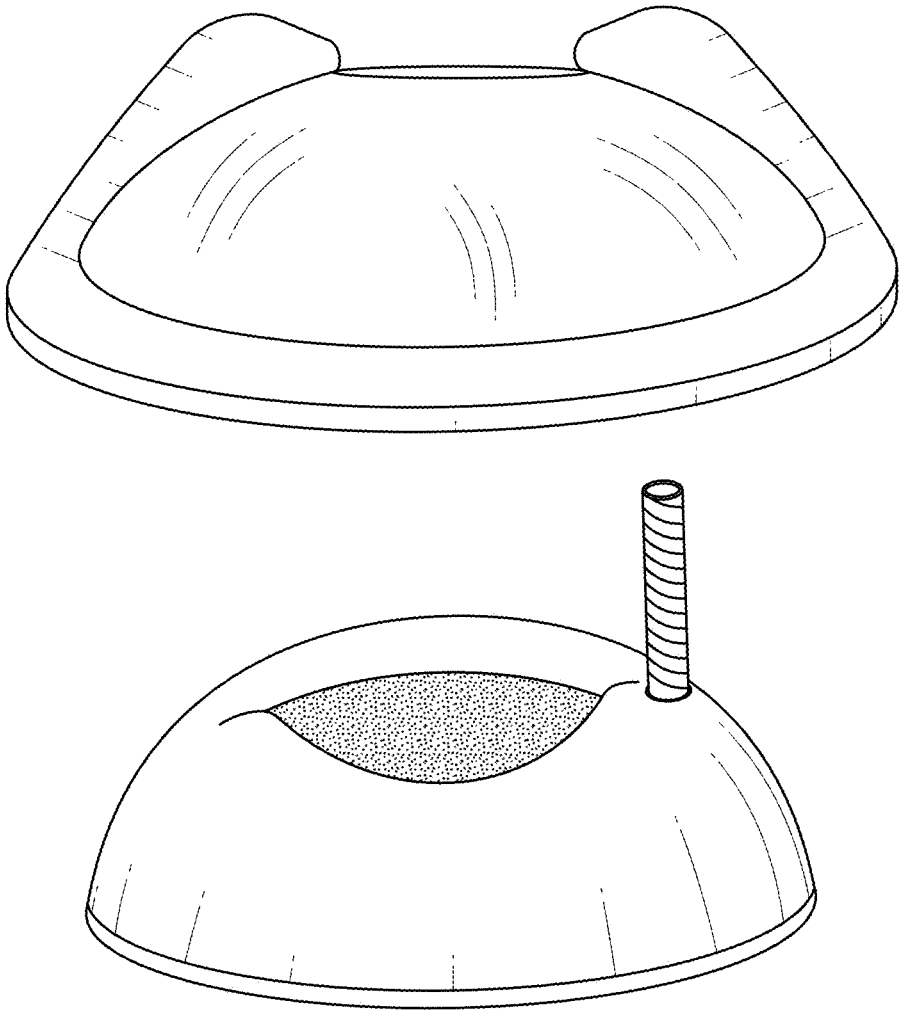
FIG. 16 is an isometric exploded view of an exemplary two-part cover for use with a container, such as those depicted herein.

FIG. 14 presents an embodiment of a divided container that includes a creased divider that separates a container with a closed peripheral wall from a container with a peripheral wall having two elongate vertical openings. The openings can be of any desired shape. The embodiment of FIG. 15 presents a container that may be divided on its interior and includes a "hammer" shaped opening that includes a displaceable flap depending downwardly from the upper edge of the opening. FIG. 16 illustrates an example of a two-piece lid for a container, such as the containers disclosed herein, having a first lower portion defining a bowl in a center thereof and an opening for a straw, and a separable cover portion. The bowl can be of any desired shape, and may include more than one compartment.

Figure 17:
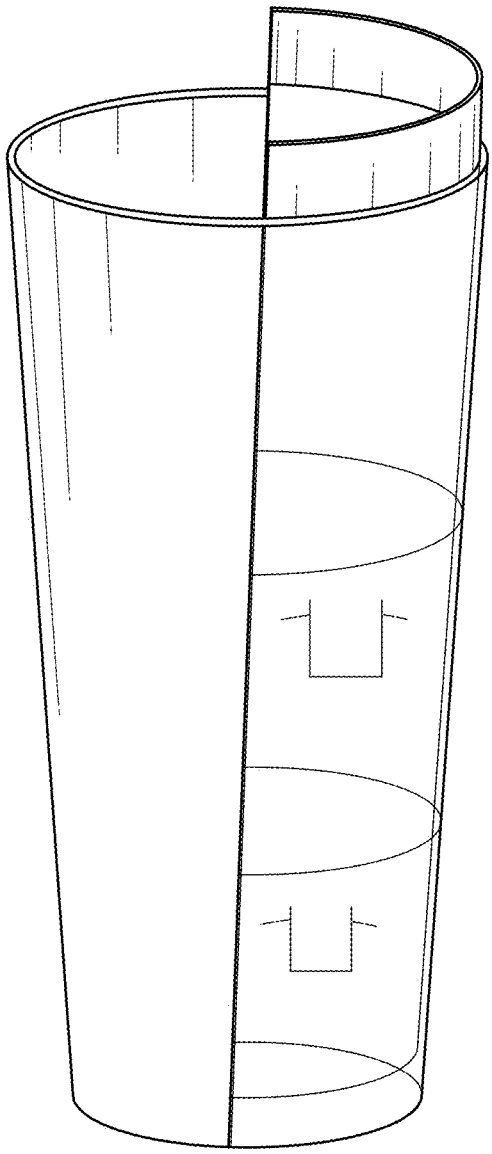
FIG. 17 is an isometric view of a nineteenth exemplary embodiment of a container in accordance with the present disclosure.

FIG. 17 illustrates an embodiment of a container with a snack lift or elevator. Specifically, the container is divided, including a first compartment that has a closed peripheral wall, and a second, adjacent compartment having a plurality of stacked compartments attached to a liftable tab. Food items in an upper compartment can be accessed. When empty, the tab can be pulled upwardly, lifting the uppermost container out of the container, and exposing the next container down. If desired, the inner surface of the outer container can include tabs that slide over the containers as they lift, and lock into place underneath (or into) the containers when they are lifted, holding them in place.

Figure 18A:
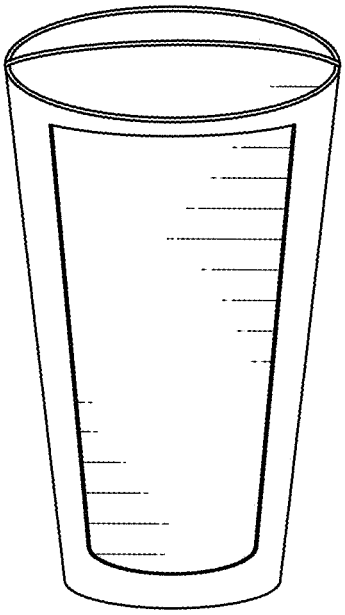
FIGS. 18A-18D are isometric views of twentieth, twenty first, twenty second and twenty third exemplary embodiments of a container in accordance with the present disclosure.
Figure 18B:
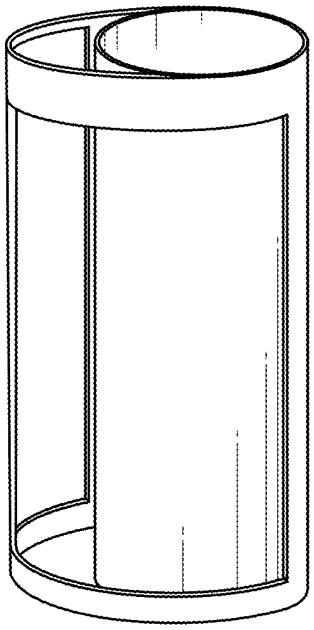
Figure 18C:
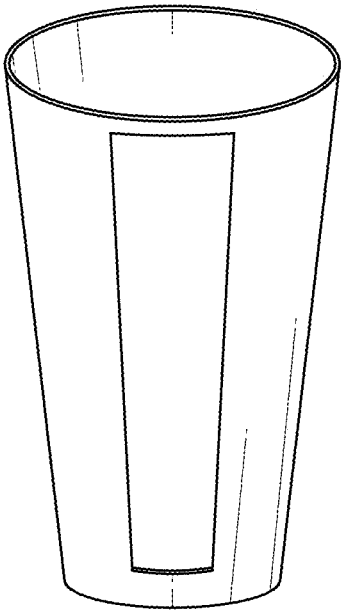
Figure 18D:
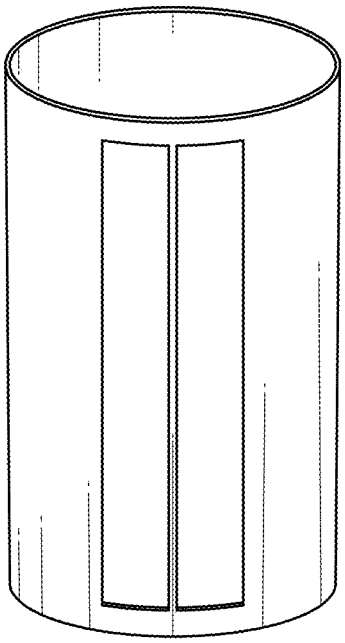

FIG. 18A illustrates an example of a divided container having a relatively wide side opening in a container compartment having a round horizontal cross-section that is surrounded by a second compartment having a crescent-shaped cross section. FIG. 18B illustrates an opposite concept, wherein the compartment having a round horizontal cross-section has no side opening, but is surrounded by a second compartment having a crescent-shaped cross section with a vertical opening having a significant annular extent, wherein the opening is divided at its center by a vertical support. FIG. 18C illustrates a container having a relatively narrow vertical opening, and the embodiment of FIG. 18D includes a plurality of flap covers covering one or more openings to protect the contents of the container and to prevent the contents from falling out of the container.

Figure 19A:
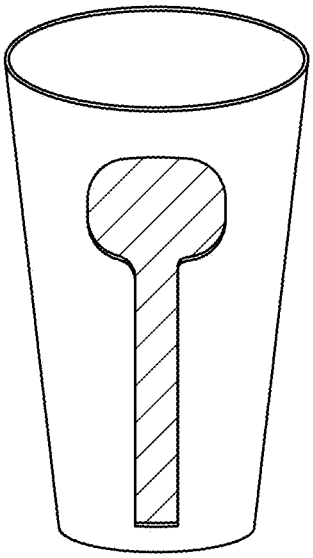
FIGS. 19A-19E are isometric views of twenty fourth, twenty fifth, twenty sixth, twenty seventh and twenty eighth exemplary embodiments of a container in accordance with the present disclosure.
Figure 19B:
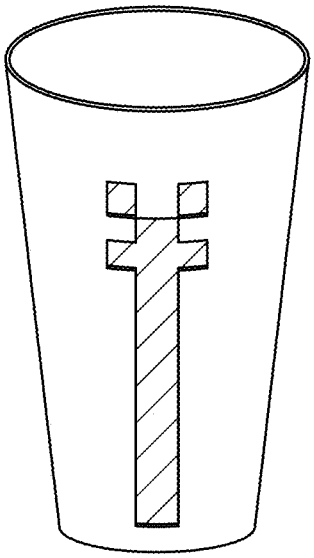
Figure 19C:
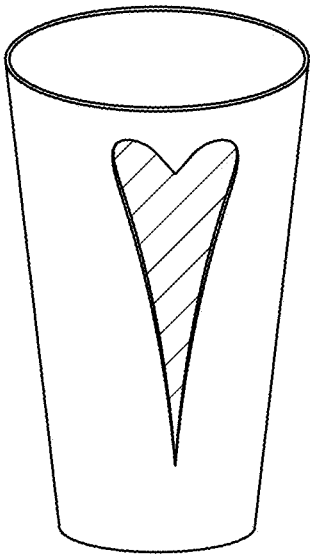
Figure 19D:
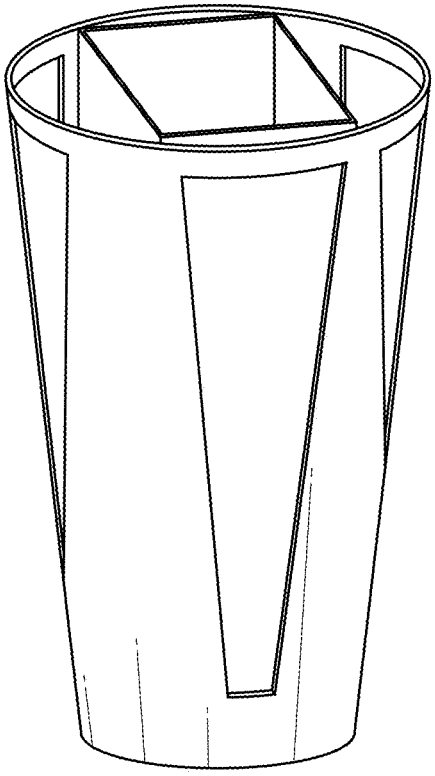
Figure 19E:
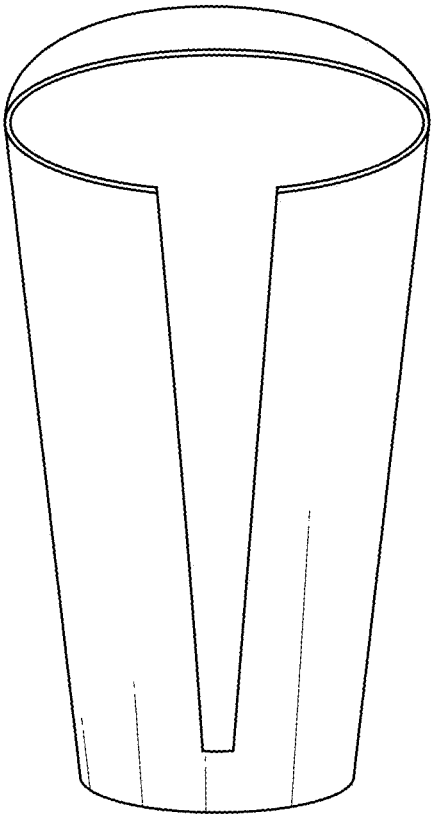

FIGS. 19A-E illustrate still further embodiments of containers in accordance with the present disclosure. FIG. 19A illustrates a first embodiment having a "lollipop" shaped opening comprising an upper circular opening that is intersected by a lower vertical opening. FIG. 19B illustrates a container with an opening that resembles an elongate cross with two square shaped openings above the cross. FIG. 19C illustrates a container with an elongate heart shaped opening. FIG. 19D provides a container with five interior compartments defined by a divider wall having a square cross section formed by four intersecting walls, defining a central compartment having a square shaped horizontal cross section and four identical side compartments having semicircular cross sections with elongate wedge-shaped vertical openings in exterior walls thereof. FIG. 19E illustrates an embodiment of a divided container having an elongate side opening that has an open top.

Figure 20:
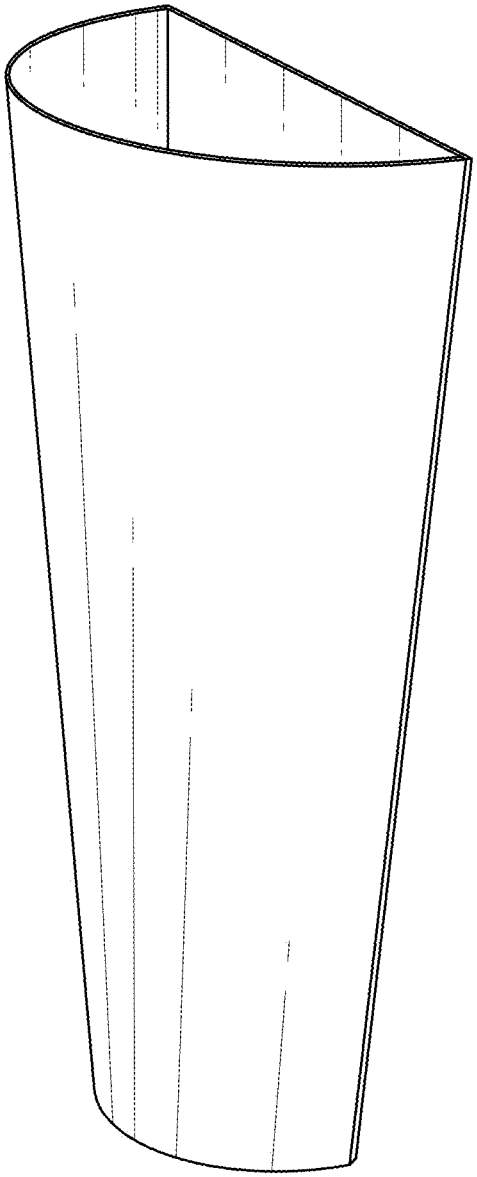
FIG. 20 is an illustrative embodiment of a thermal insert in accordance with the present disclosure.

FIG. 20 illustrates a thermal insert that is configured and shaped to be received by a compartment of a container disclosed herein. It will be appreciated that such an insert can be shaped to be received by any compartment of any container disclosed herein. The thermal insert can include one or more insulating materials such as expanded styrene and the like, or any material of relatively low thermal conductivity.

Figure 21A:
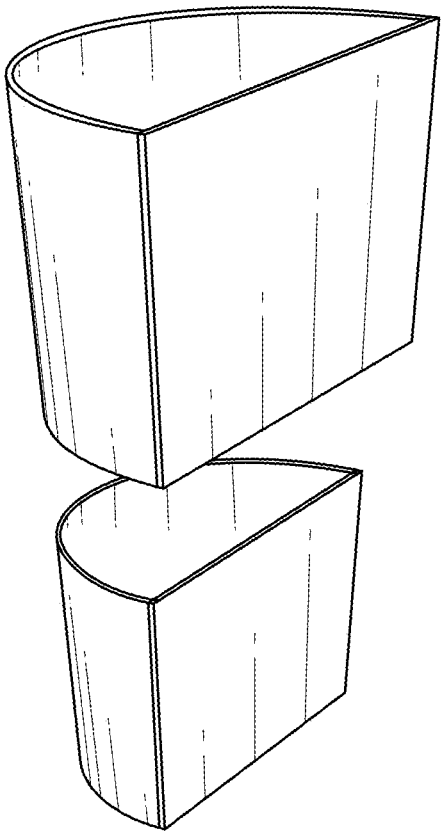
FIGS. 21A-21B are isometric views of illustrative compartment boxes in accordance with the present disclosure.
Figure 21B:
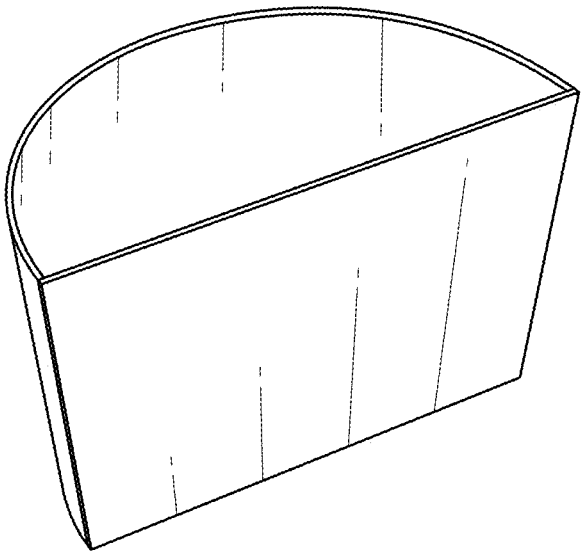
Figure 22:
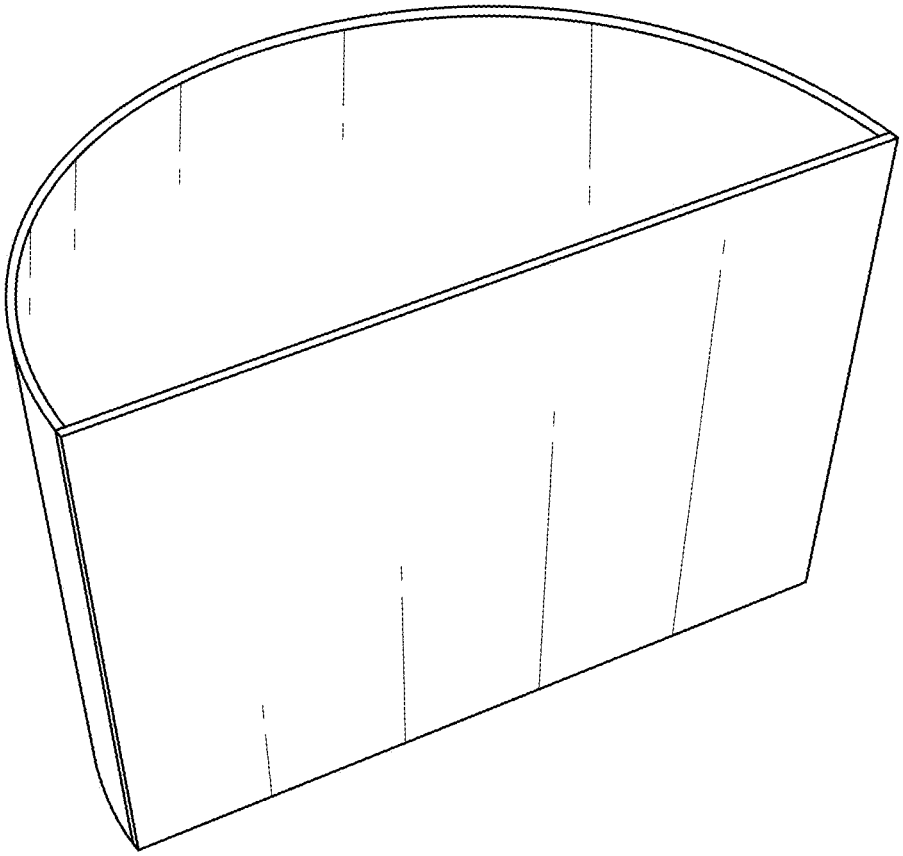
FIG. 22 is an illustrative embodiment of an elevation platform in accordance with the present disclosure.

FIGS. 21A-21B illustrate examples of compartment boxes that can be received by subdivided containers disclosed herein. The depicted compartment boxes can be semicircular, as disclosed, or have any other desired shape to match the horizontal cross section of any container disclosed herein. As will be appreciated, the compartments can be tapered such that lower compartments will have smaller horizontal cross sections than upper compartments. Similarly, an elevation platform can be provided in any container disclosed herein, as illustrated in FIG. 22. The elevation platform can include a platform supported by one or more downwardly depending walls that conform to the shape of any desired compartment of any container disclosed herein.

Figure 23A:
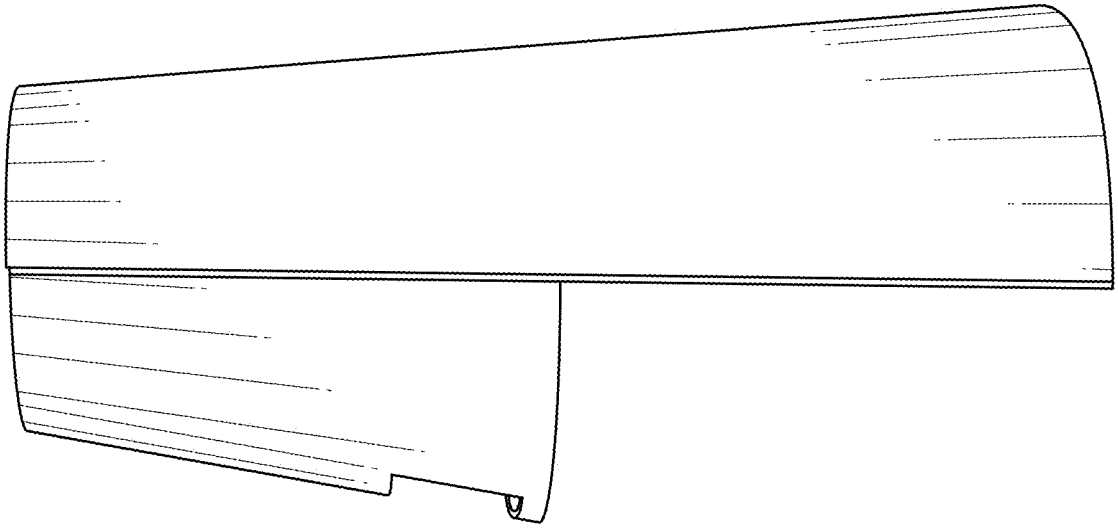
FIGS. 23A-23C are isometric views of an illustrative embodiment of a multiple compartment container in accordance with the present disclosure.
Figure 23B:
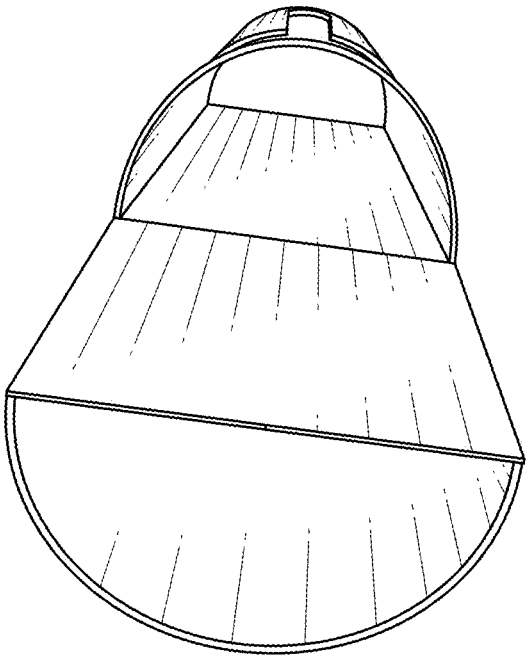
Figure 23C:
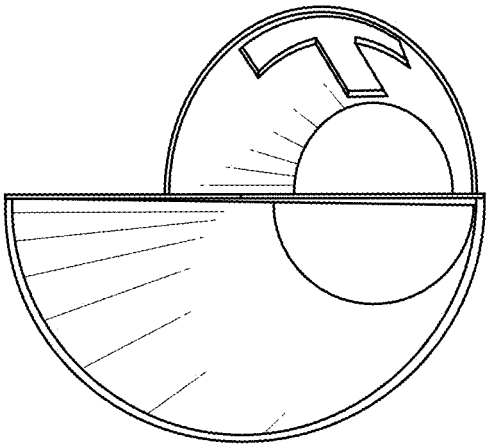

FIGS. 23A-23C illustrate an embodiment of a modular container, wherein the container is made by assembling modules to form a cup shaped container. Thus, for example, a tall compartment containing a beverage can be mated to one or more containers including food items. The modules can be snapped together, for example, via interference fit or adhesive, as desired.

Figure 24:
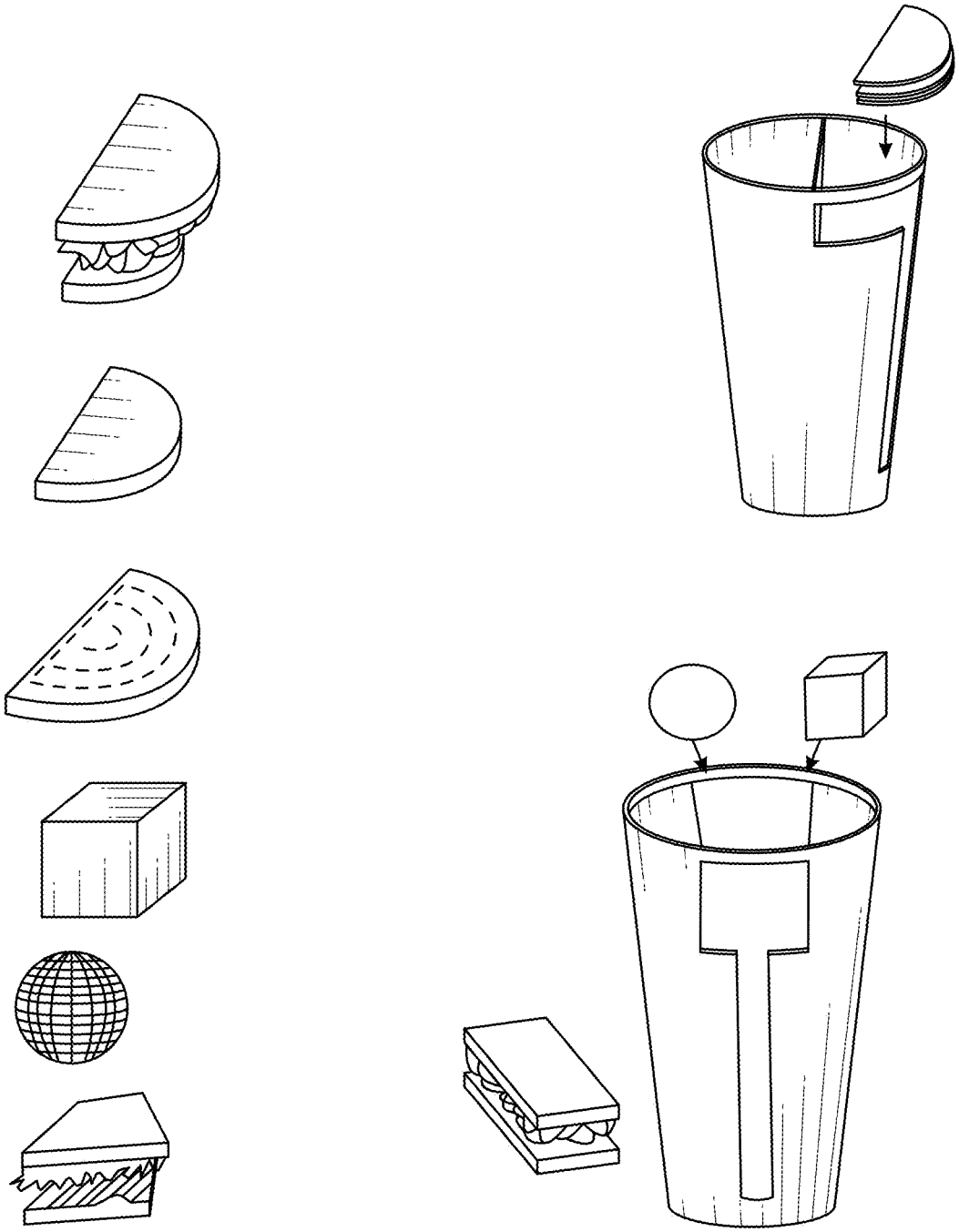
FIG. 24 illustrates various embodiments of comestible products in accordance with the present disclosure in combination with illustrative containers provided in accordance with the present disclosure.

FIG. 24 illustrates ways in which food items can be manufactured to specially match the horizontal cross sectional shapes of containers disclosed herein. For example, semicircular shaped food items can be manufactured, such as sandwiches, sliders, wraps, and the like having dimensions that match those of the compartments of the container. Similarly, other snack foods such as potato chips, tortilla chips, pizza rolls, quesadillas, chicken fingers, ravioli, pierogies, pre-cut fruit and vegetables and the like can be manufactured to match the containers. Moreover, spherical and cube shaped foods can be provided such as Rice Krispy® treats, brownies, cookies, chocolate candies, ice cream bites, and the like.

Figure 25:
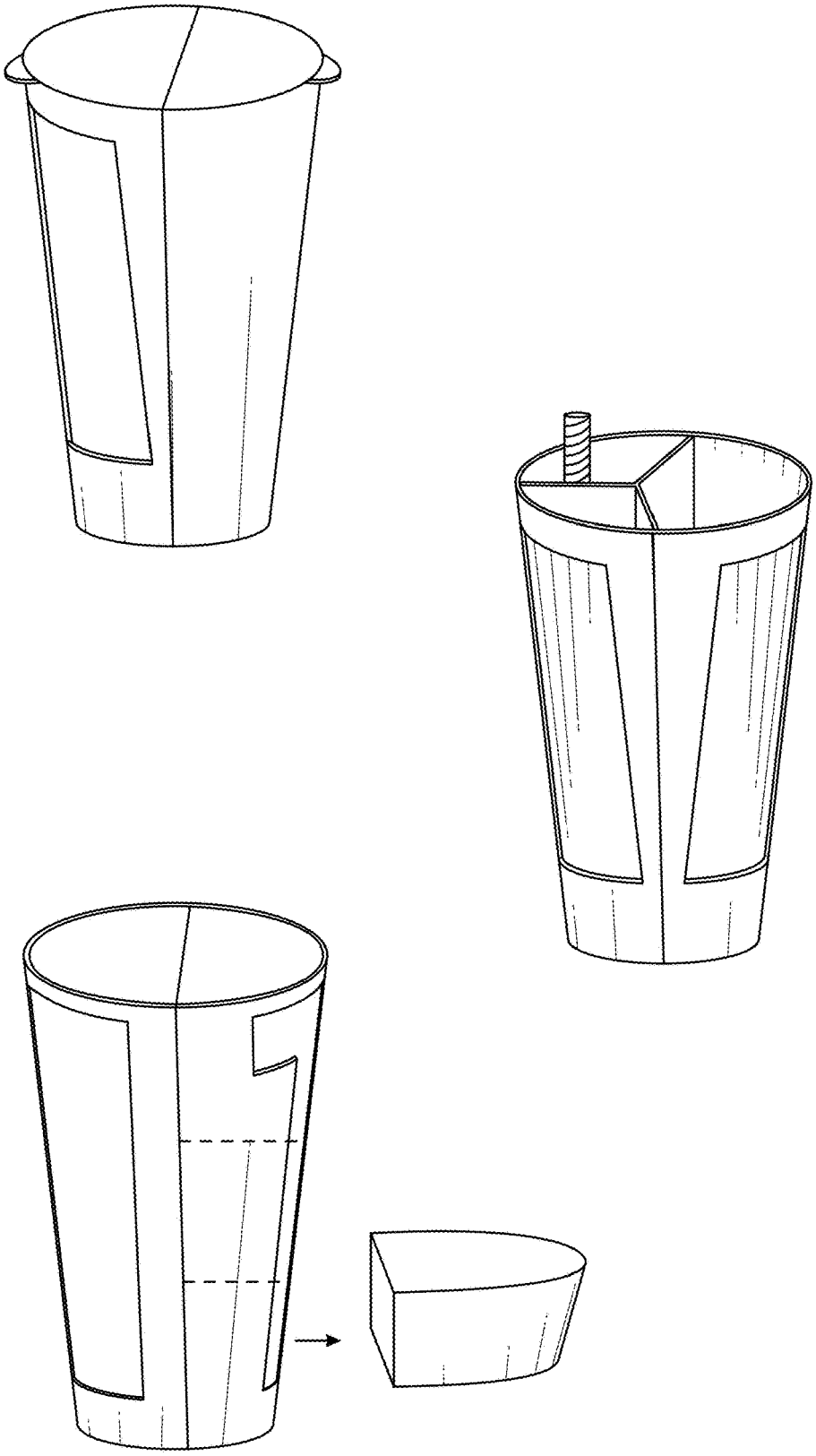
FIGS. 25-29 depict illustrative embodiments of a prepackaged container with comestible products in accordance with the present disclosure, or aspects thereof.

FIG. 25 further illustrates how different compartments in the disclosed containers can be used for different kinds of prepackaged comestible items. As illustrated, the container can be provided with prepackaged items covered by foil or other outer wraps that are removed to access the items within the container. For example one side of a container can be provided with chips, vegetables or other items to be dipped in a dip, and the other compartment can be provided with dip. The items to be dipped can be pulled out from the side of the container or the top. A removable foil or paper can cover the side opening that is progressively peeled down, or up, as desired, to access the food items. Similarly, prepackaged comestible items can be provided in stackable compartments that are stacked into the container compartments. The compartments can be pulled out of the container upwardly, or accessed through side access ports through an outer wall of the container, as desired. Moreover, the container can be assembled into a cup shape by purchasing pre-packaged food modules that are then snapped or adhered together or otherwise attached to each other.

Figure 26:
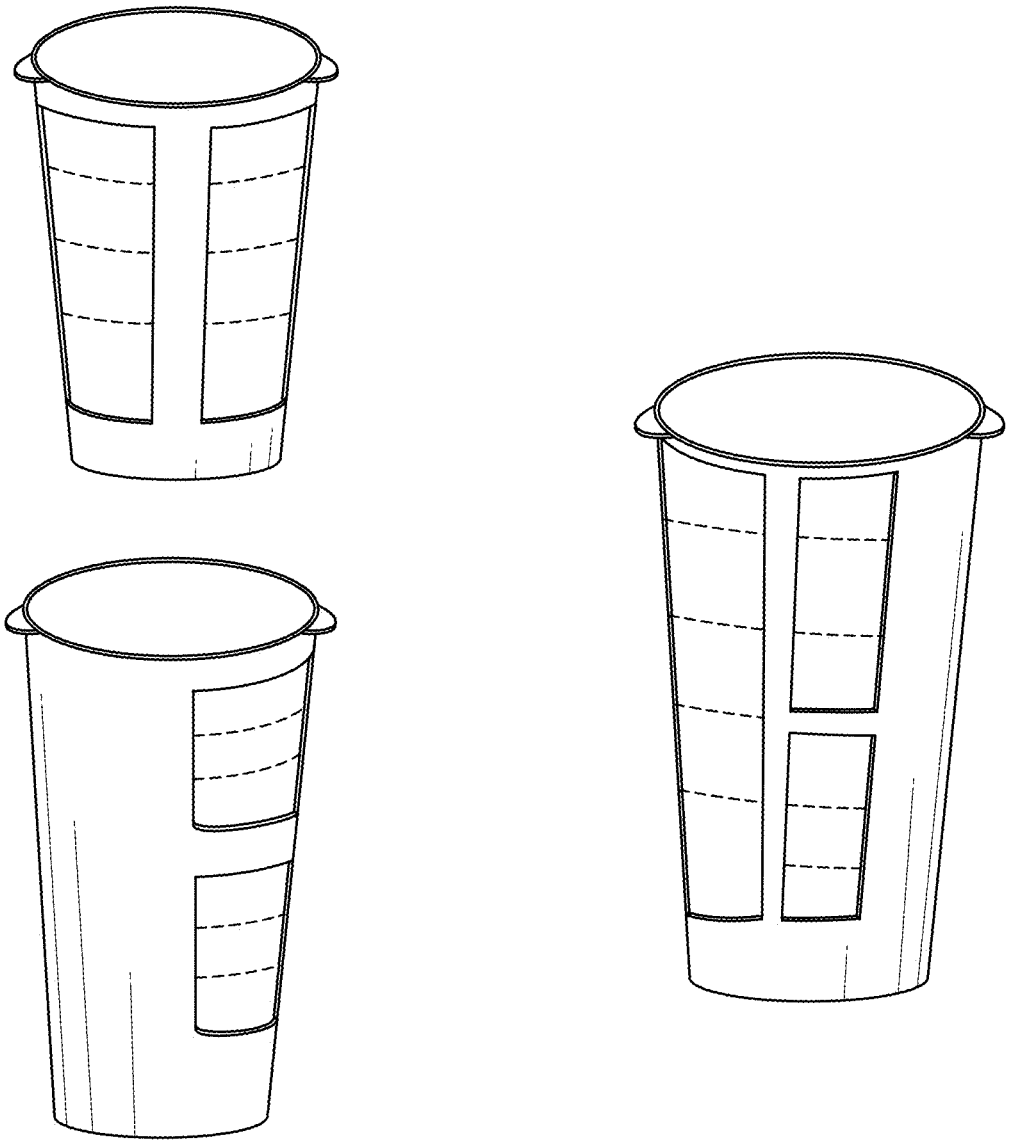

FIG. 26 illustrates embodiments of prepackaged containers having various peel off adhesive strips covering different respective compartments. Compartments can be separated using horizontal or vertical dividers.

Figure 27:
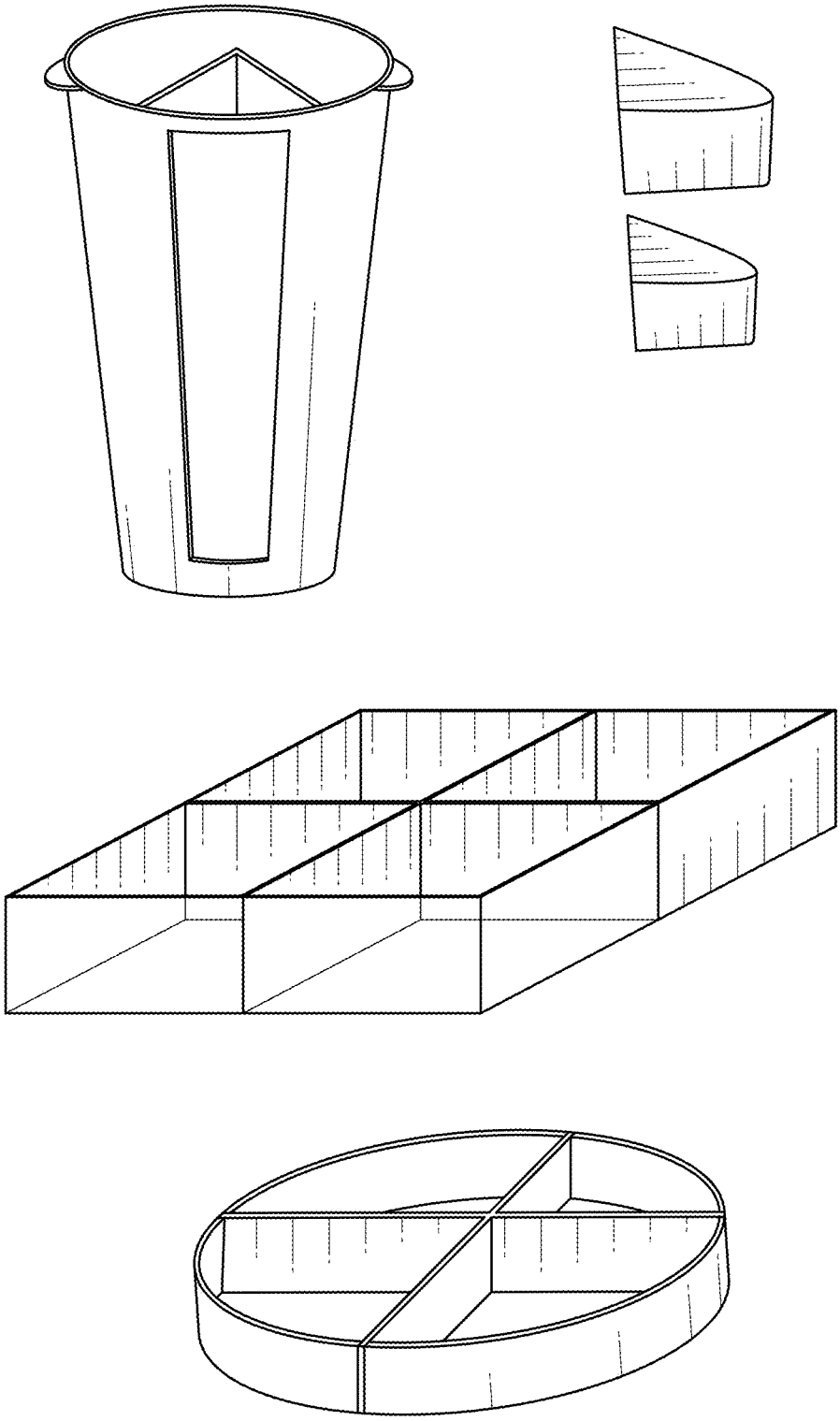
Figure 28:
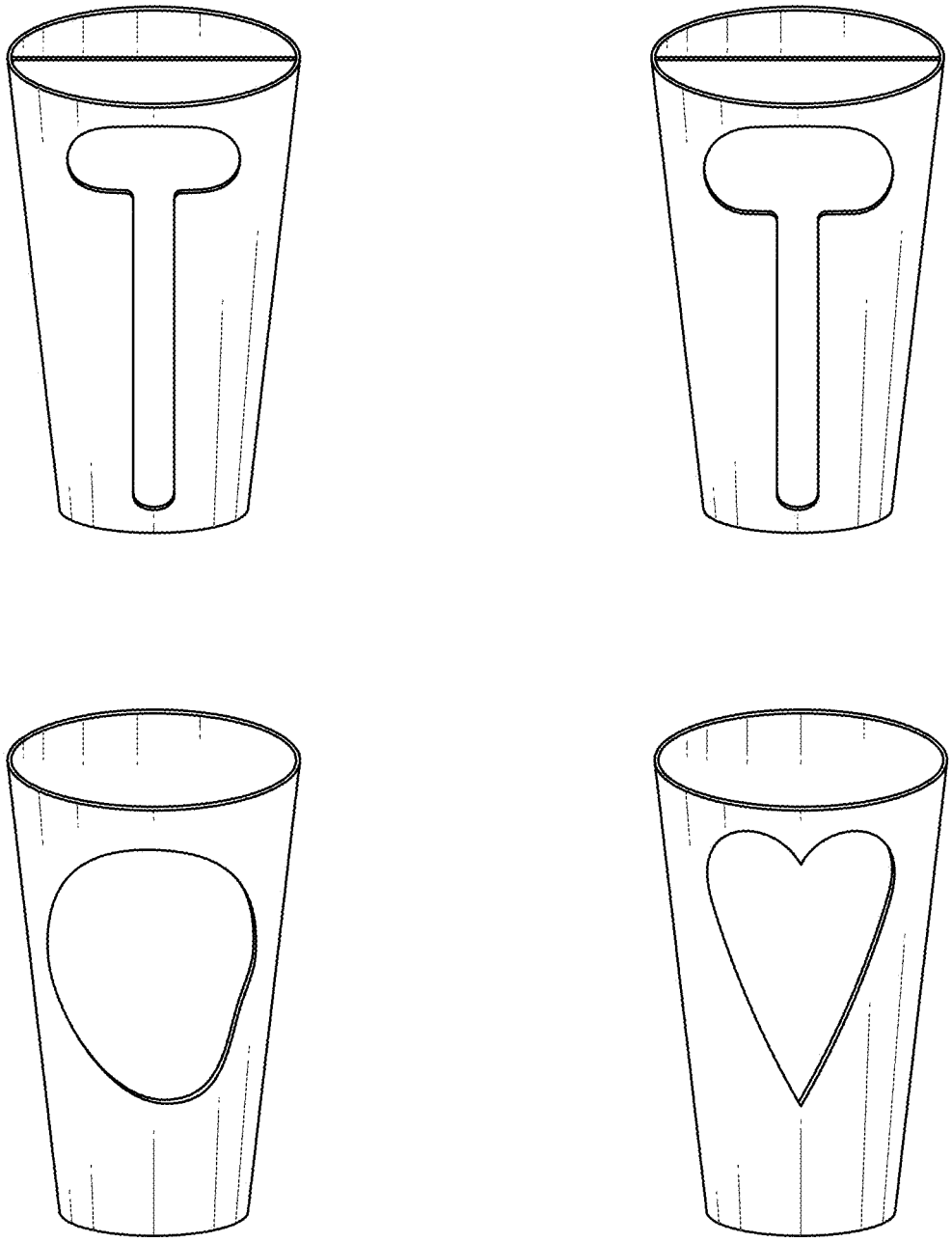
Figure 29:
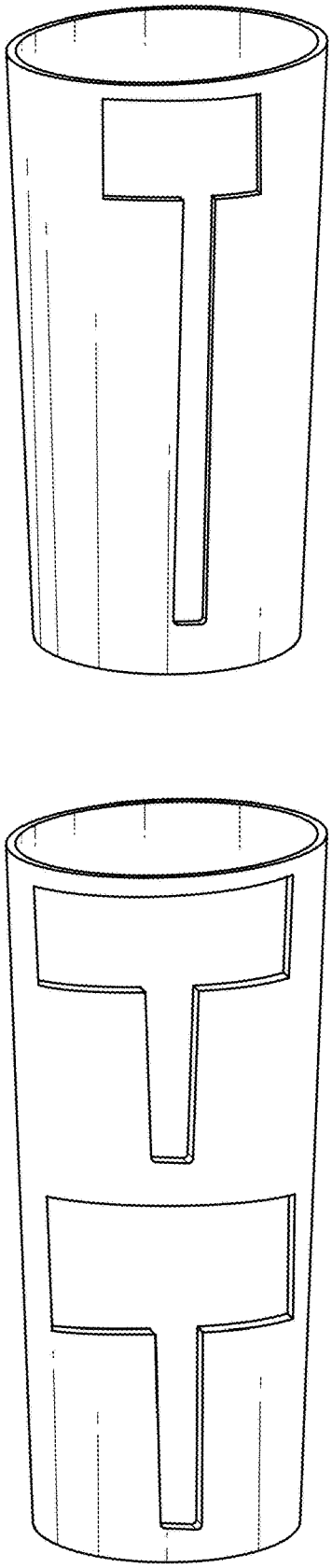
Figure 30C:
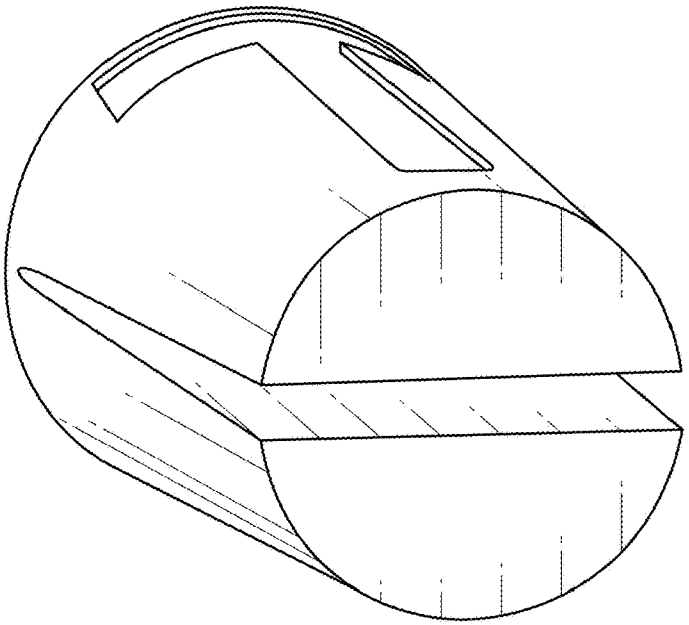
FIGS. 30A-30E depict a further illustrative embodiment of a stackable divided container having two compartments.
Figure 30B:
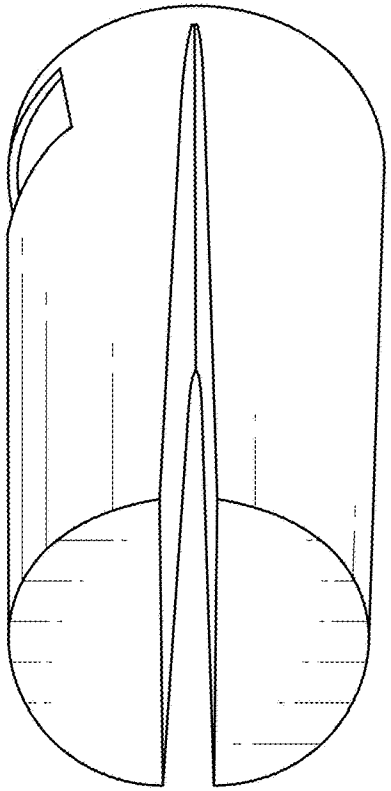
Figure 30A:
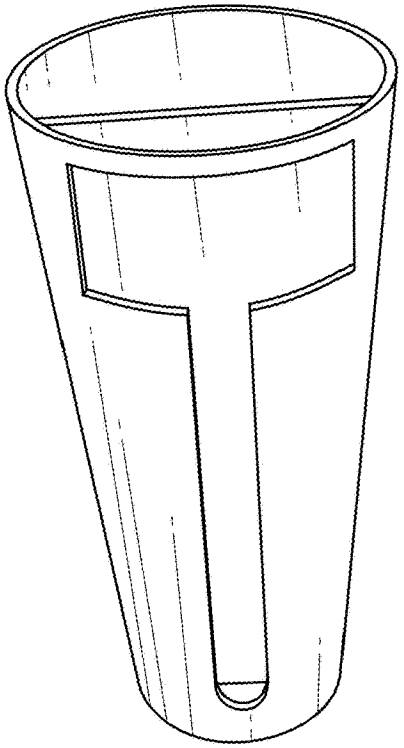
Figure 30D:
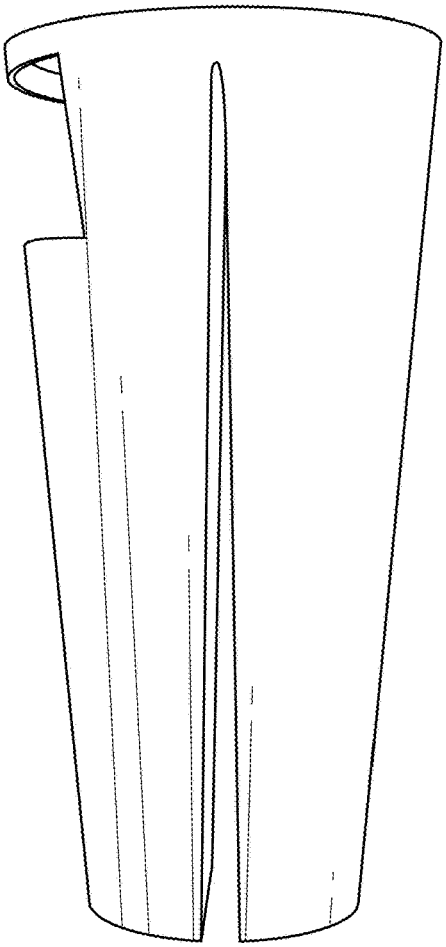
Figure 30E:
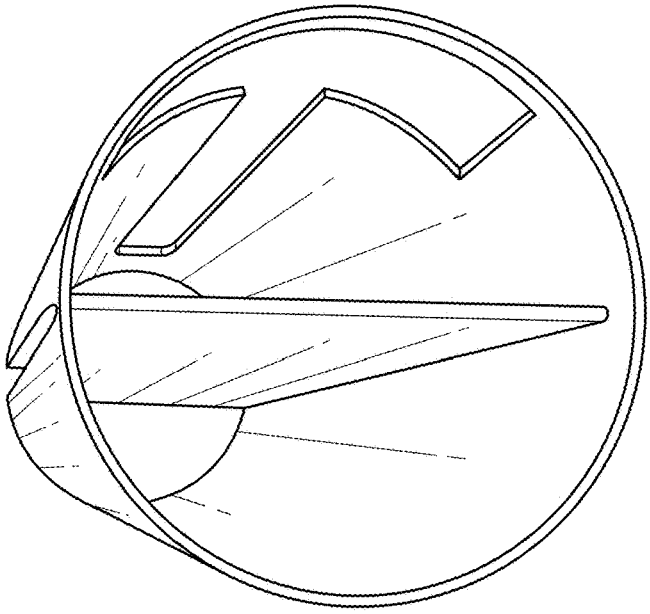
Figure 31A:
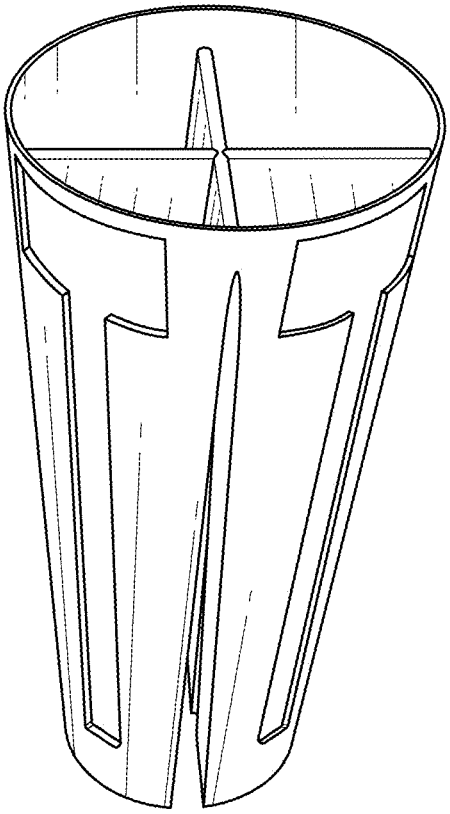
FIGS. 31A-31F depict an illustrative embodiment of a stackable divided container having four compartments.
Figure 31B:
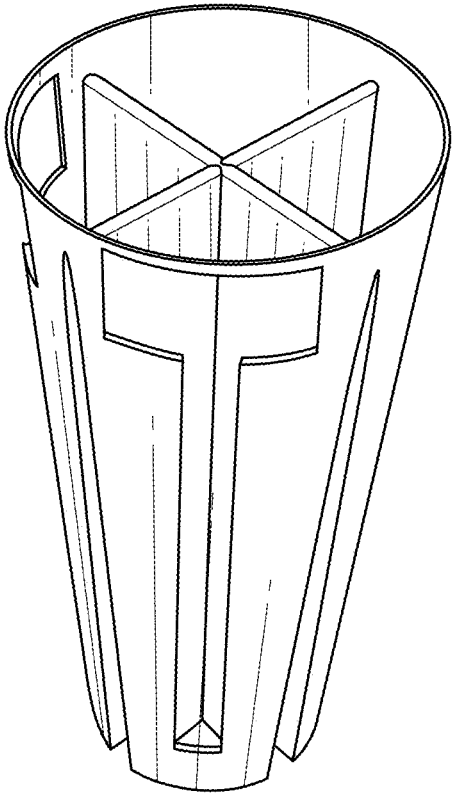
Figure 31C:
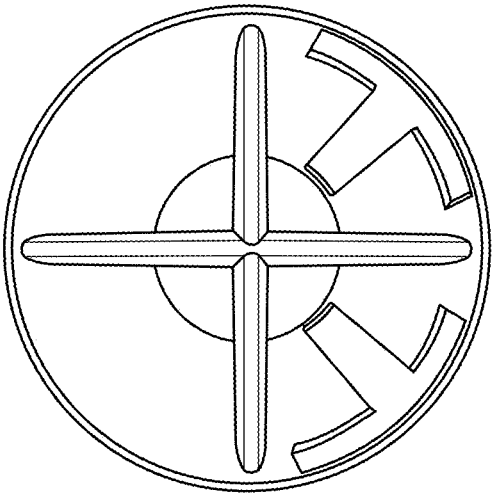
Figure 31D:
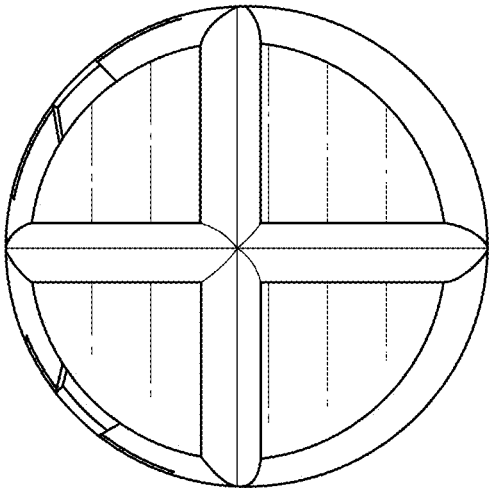
Figure 31E:
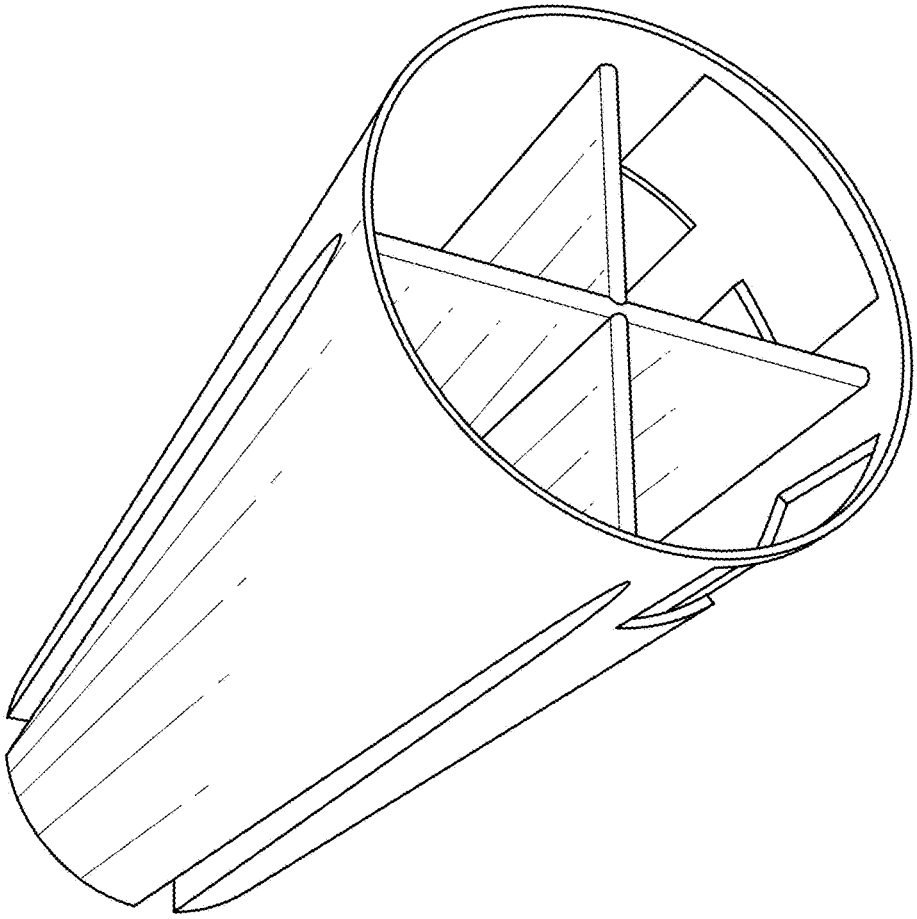
Figure 31F:
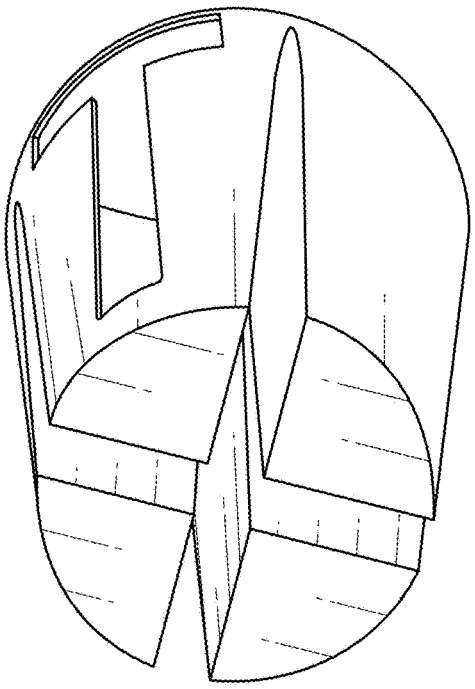
Figure 32A:
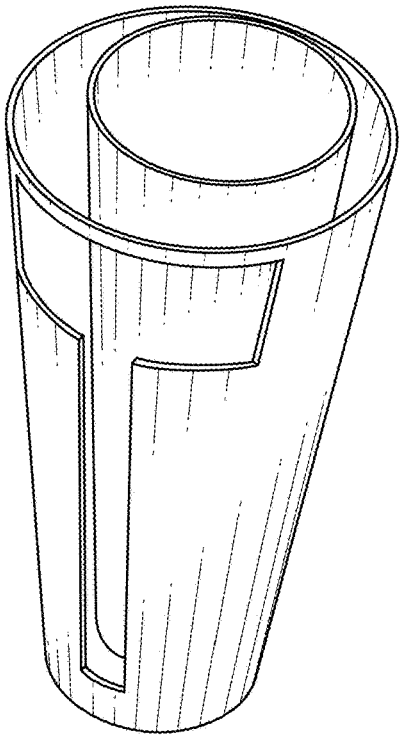
FIGS. 32A-32D depict an illustrative embodiment of a vessel within a vessel.
Figure 32B:
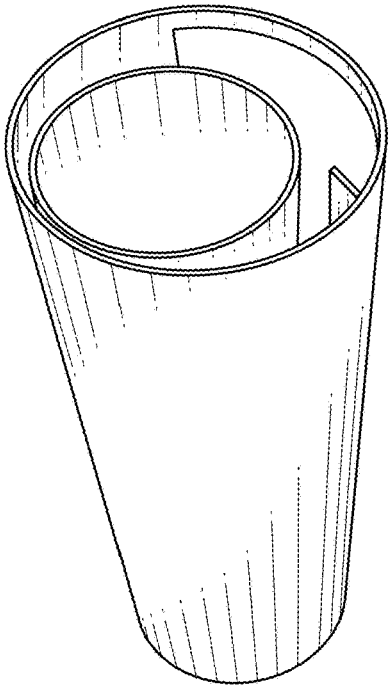
Figure 32C:
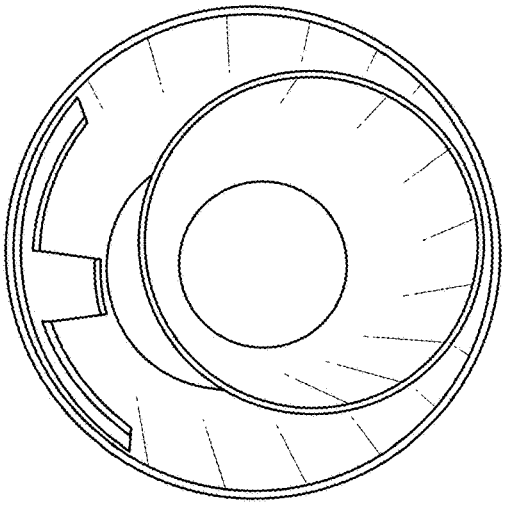
Figure 32D:
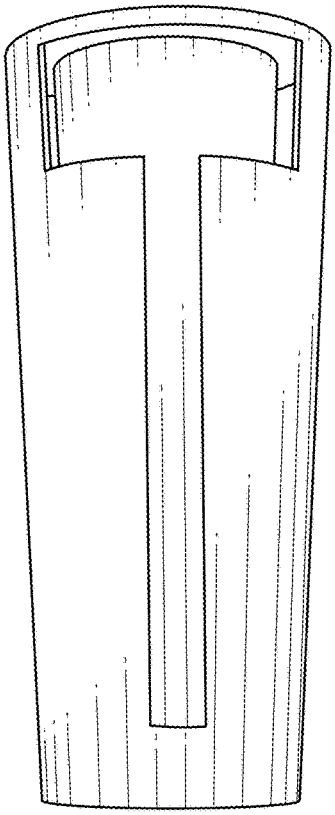

FIG. 27 illustrates "cookie-cutter" like food cutters that can be used to shape foods (such as fruit, sandwiches, cakes or the like) for containers as disclosed herein. For example, food can be cut into shapes similar to pie slices, squares, semicircles, and the like. As illustrated in FIG. 28, the openings in the sides of the container can be shaped to match the shape of the food products to facilitate their removal through the wall of the container. For example a rounded opening can be provided to match that of a bagel, donut or hard boiled egg, and the like. FIG. 29 illustrates still further alternate embodiments, the first having a hammer shaped side opening that is more elongate with a relatively smaller "head" and a second embodiment having two spaced apart compartments (upper and lower) being accessible by vertically displaced "hammer" shaped openings.

FIGS. 32A-32D illustrate a further embodiment of a vessel within a vessel wherein a first, inner cup with a continuous side surface without openings is placed within a second, outer cup with a discontinuous side surface having a hammer shaped opening as described herein, wherein the first cup is located along a continuous interior portion of the wall of the second cup. The cups can be integrally formed or separately formed and bonded from similar or different materials, such as paper coated with a fluid barrier layer, plastic, metal, styrofoam, and/or the like.

Figure 33A:
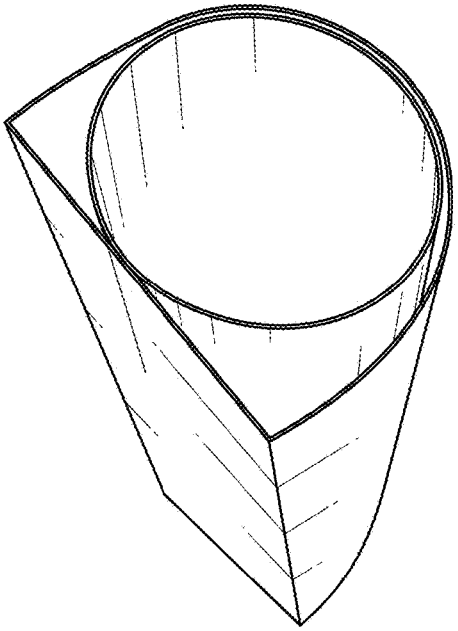
FIGS. 33A-33D depict a further illustrative embodiment of a vessel within a vessel, wherein the inner vessel is placed within a container insert/spacer.
Figure 33B:
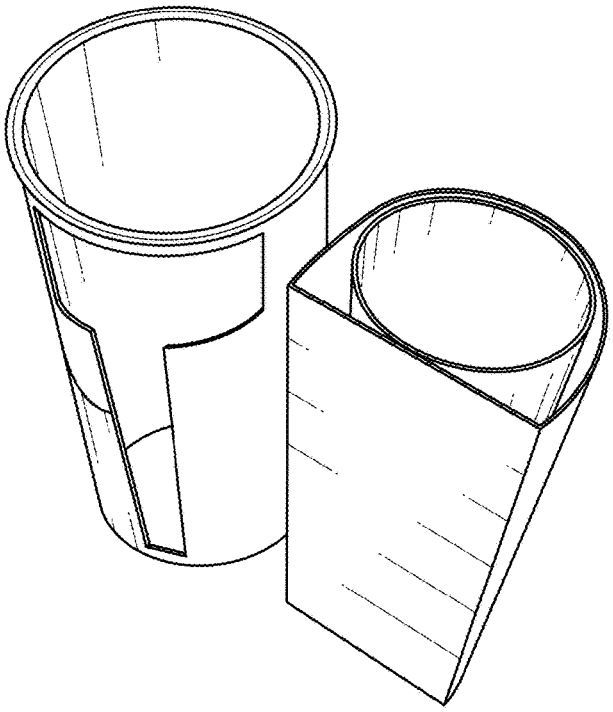
Figure 33C:
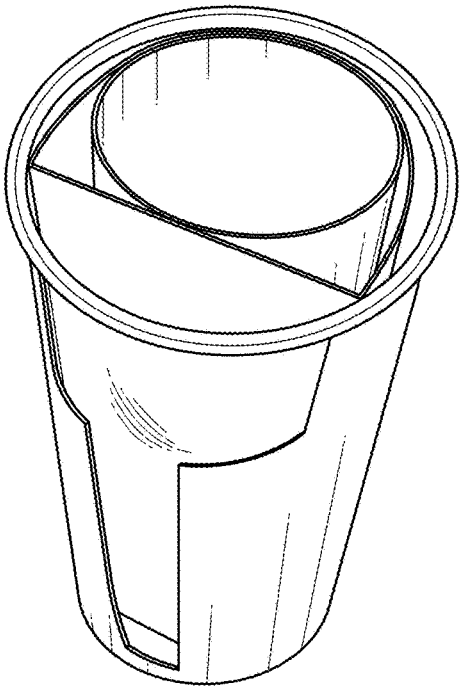
Figure 33D:
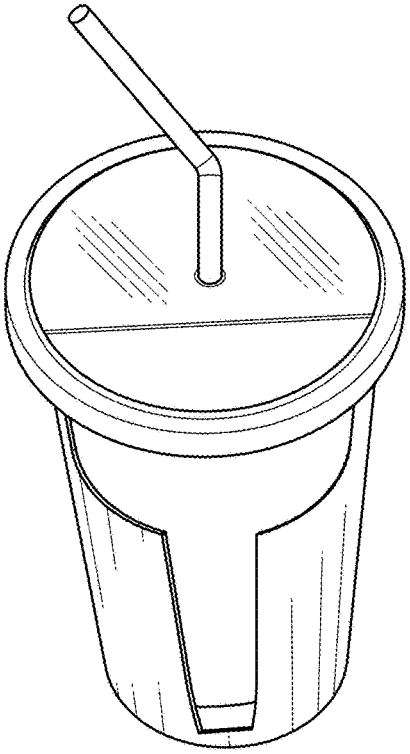

FIGS. 33A-33D depict a further illustrative embodiment of a vessel within a vessel, wherein the inner vessel is placed within a spacer, or "compartment insert" as also used herein. Specifically, a compartment insert with a "D" shaped cross section is fitted around the inner cup, and then placed within an outer cup. The compartment insert maintains the spatial relationship between the inner and outer vessels. A flat side of the compartment insert cooperates with an inner surface of the outer vessel to define a vertical space also having a "D" shaped cross section that tapers from the top to the bottom. FIG. 33D shows the completed assembly with a lid and straw directed into the inner vessel. The compartment insert can be made of one single sheet of paper, card stock, cardboard, plastic or other materials.

Compartment inserts can be made in different shapes and sizes, allowing for customizable compartments to match/accommodate specific types, configurations and uses of the specific cup (or other container). Some compartment inserts may create one single compartment while others may create multiple compartments. Compartment inserts may hold comestibles, food, snacks, liquids, eating utensils, napkins and any other suitable articles. Compartment inserts may also hold compartment cups, containers, food/drink holders, additional compartment inserts and the like.

Figure 34A:
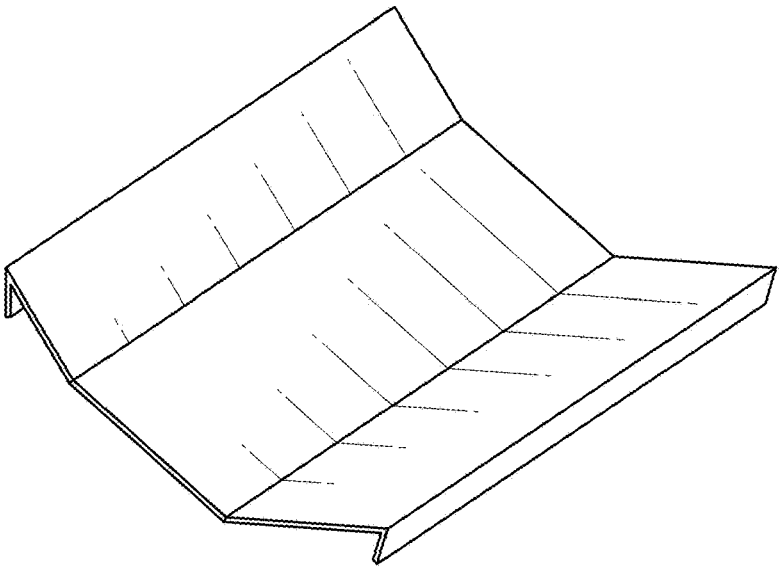
FIGS. 34A-C depict a food insert with a comestible product inserted therein for being received by an outer cup/container.
Figure 34B:
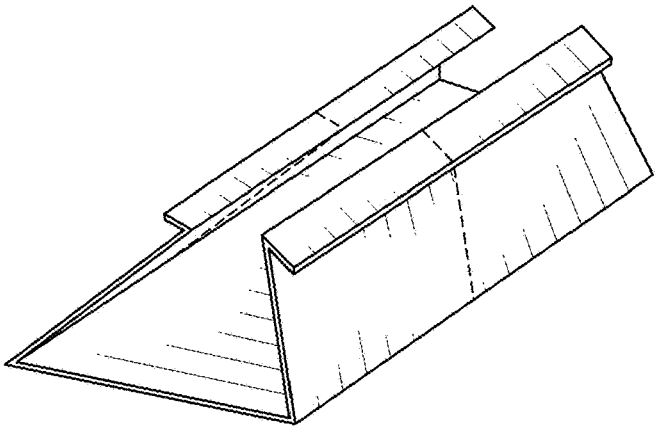
Figure 34C:
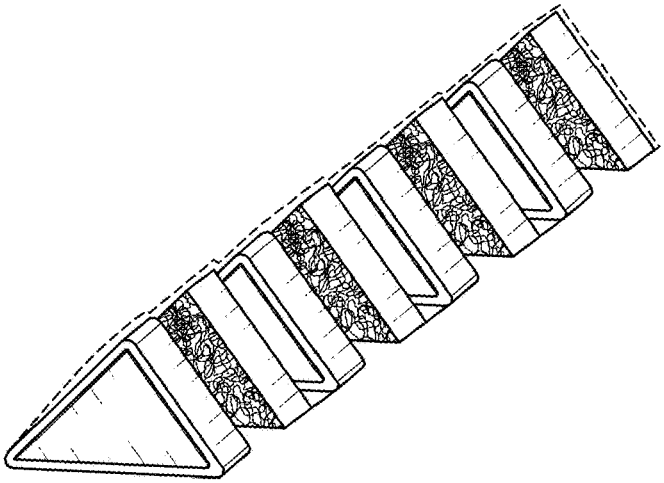

FIGS. 34A-C illustrate use of a compartment insert/spacer for holding triangular sandwich quarters or mini sandwiches that are stacked together and ultimately placed into a compartment insert. The resulting compartment insert, also referred to herein as a food holder insert, thus containing comestible items, can be slid into a specific slot, location, or compartment within an outer cup/container where it will ultimately be accessible to the user via the openings in the walls of the outer cup/container. The illustrated example utilizes sandwiches for one specific illustration, but it will be appreciated that a wide array of comestible items can be utilized.

The food holder insert can be provided with peripheral flaps along each edge as illustrated to facilitate securing the food holder insert within the outer cup or container. Perforated areas of the food holder insert can be provided to assist the user in accessing the comestible items within the food holder insert via the larger exterior opening of outer cup/container, such as by rupturing the perforation and pushing the food items upward with a user's finger. Alternatively, the food holder insert can be pulled upward if not attached to the outer container to remove food items, or a further insert can be provided that slides within the food holder insert such that the entire insert can be removed by pulling at the top of the insert. The food holder insert can be made of paper, plastic, cardboard, or the like.

Figure 35A:
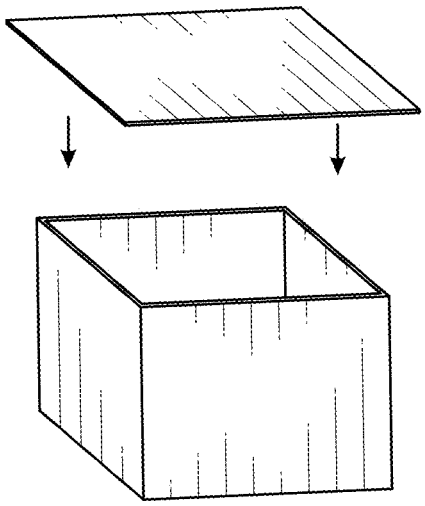
FIGS. 35A-C illustrate various aspects of an insert with a movable bottom for receiving comestible items.
Figure 35B:
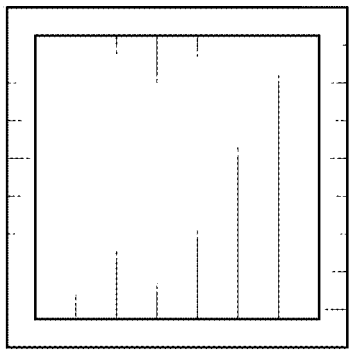
Figure 35C:
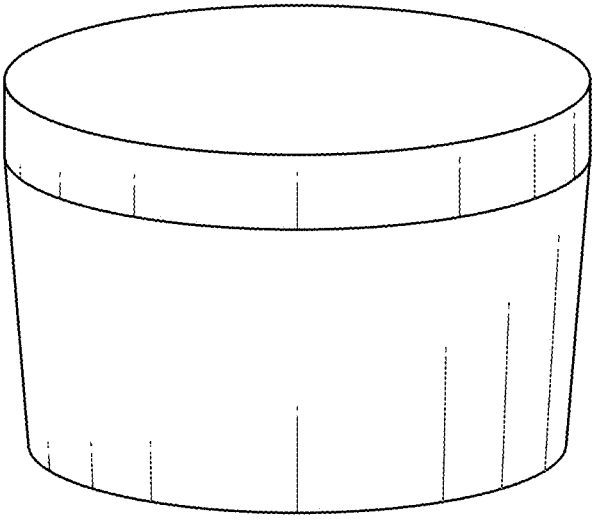

FIGS. 35A-35C illustrate further embodiments of inserts for holding food items or other comestible items. FIGS. 35A and 35B are side isometric and top views of such an insert that has a body defining a volume that accepts food items that are inserted after a removable bottom is inserted into the volume. The removable bottom rests within the insert on a lower peripheral lip. The bottom can be pushed up by a user's fingers to make the food items more accessible. FIG. 35C is a depiction of a generally cylindrical embodiment. It will be appreciated that soup cups, juice cups, liquid holders, ice cream cups, frozen yogurt cups, etc. can be stacked within the container/cup system among other items. These cups can be covered/sealed with top covers as illustrated in FIG. 35C. These cups/containers can essentially be pulled up through the smaller openings of the outer cup/Container and pulled out through the larger opening of the outer cup/container. As with other embodiments, the insert of FIGS. 35A-C can be manufactured of card stock, paper laminates, plastics and the like.

Figure 36A:
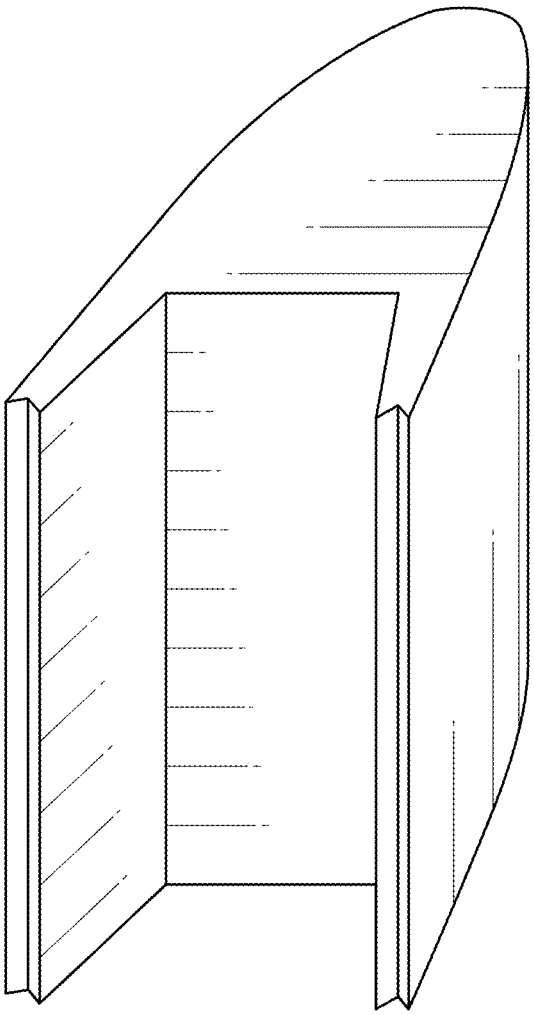
FIGS. 36A-36C depict a further illustrative embodiment of a vessel within a vessel, wherein the inner vessel is placed within a container insert/spacer.
Figure 36B:
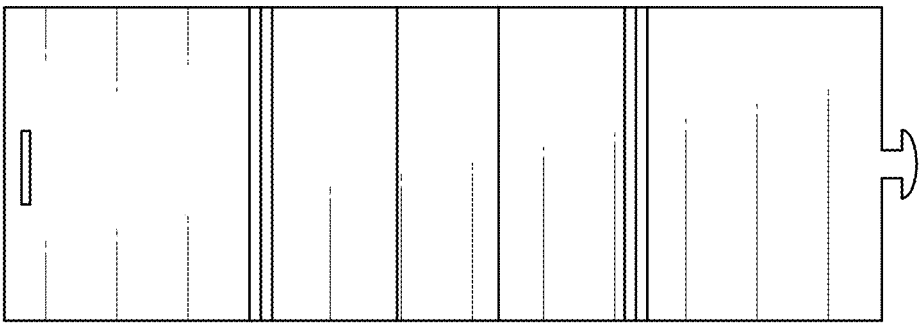
Figure 36C:
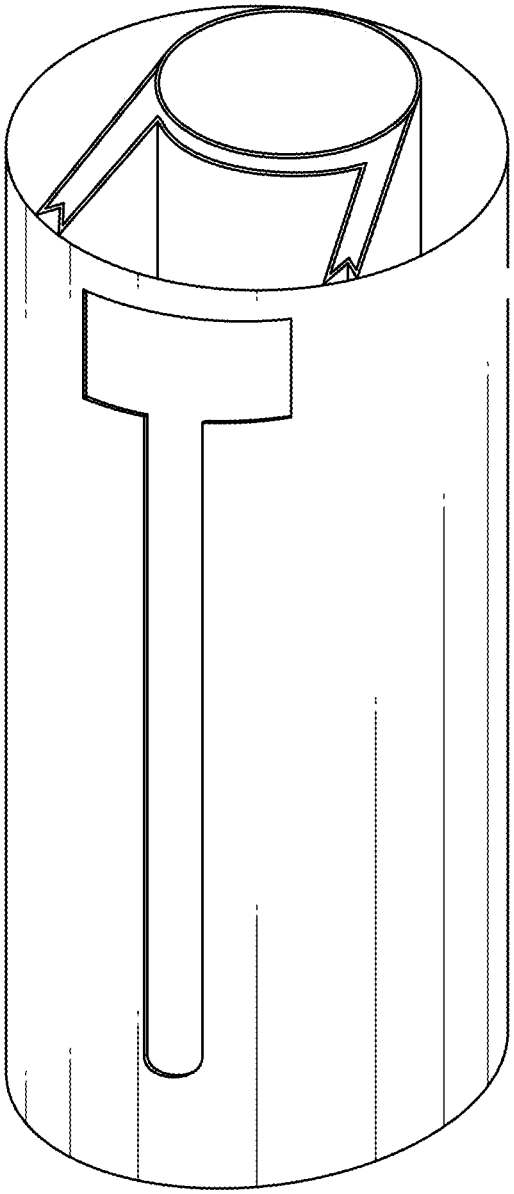
Figure 37A:
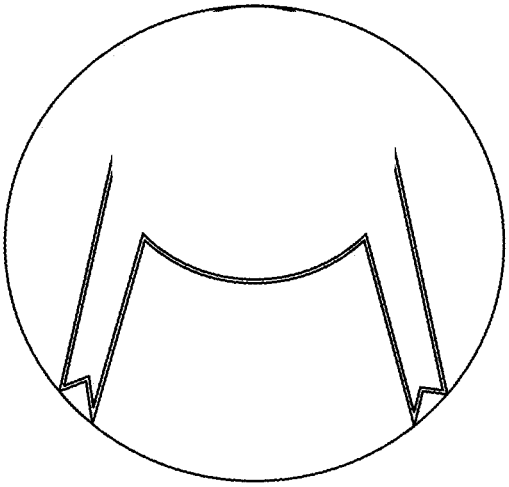
FIGS. 37A-C illustrate various aspects of a foldable container insert/spacer.
Figure 37B:
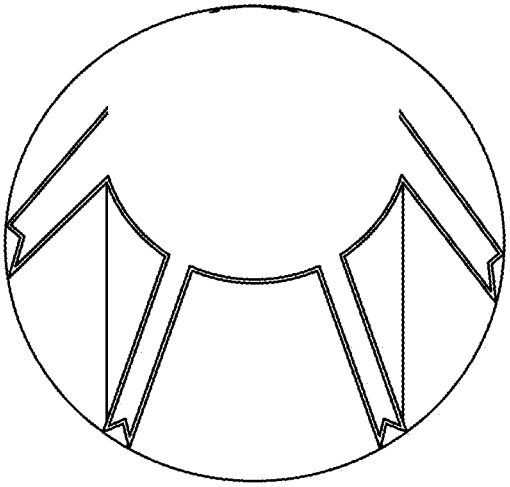
Figure 37C:
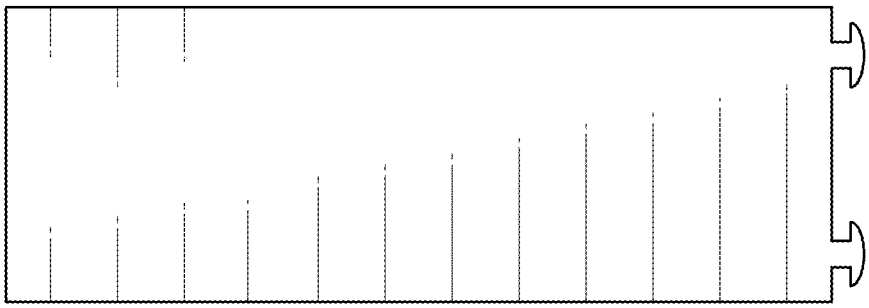
Figure 37D:
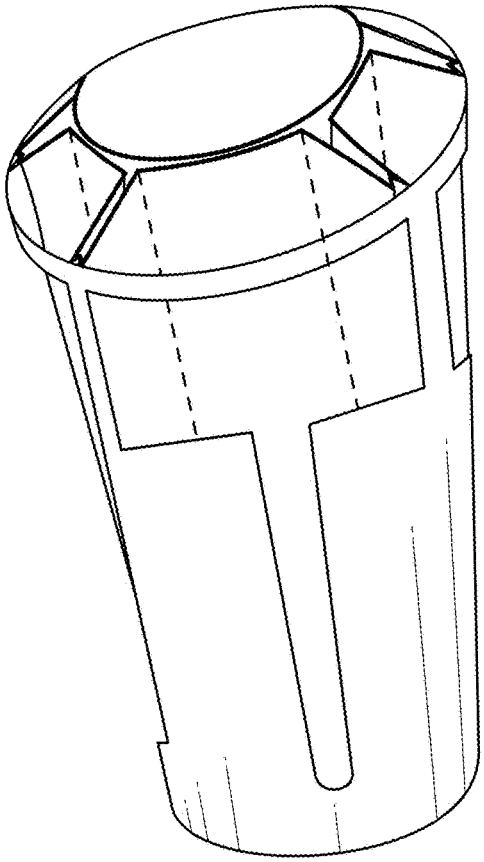

FIGS. 36A-C depict a further embodiment of a container insert made from card stock. FIG. 36B illustrates the pattern for the insert in the card stock, and FIG. 36A shows the insert folded and assembled in an upright position. FIG. 36C illustrates the insert in place inside an outer cup/container holding an inner cup/container in place. FIGS. 37A-D illustrate still further embodiments. FIG. 37A illustrates a spacer from the top as in FIG. 36 with two supporting struts, whereas FIG. 37B illustrates an insert with four supporting struts or legs. FIG. 37C illustrates a folded out pattern for an insert including mating tabs along the right edge, and insert slots along the left edge for receiving the tabs to facilitate assembly of the insert. FIG. 37D illustrates the insert of FIG. 37B inserted into an outer cup/container and housing an inner cup/container.

Figure 38:
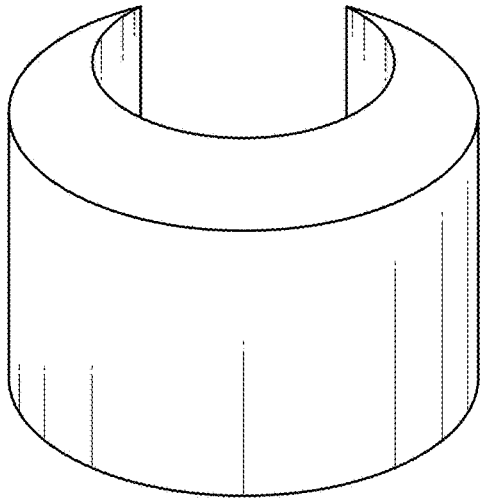
FIG. 38 presents an alternative embodiment of a container insert/spacer.

In accordance with a further embodiment, FIG. 38 presents an alternative base insert that can be inserted into the bottom of an outer cup/container to hold an inner cup/container in place that is received inside the crescent. The insert can be made from recycled paper, card stock, plastic, and the like.

In some implementations, the disclosed container can be provided with an outer shell or cover that can serves as a protecting cover/shield for the side openings of the inner cup/container, ultimately helping to protect the contents of the inner cup/container. FIGS. 39-49 illustrate further implementations in accordance with the present disclosure.

Figure 39:
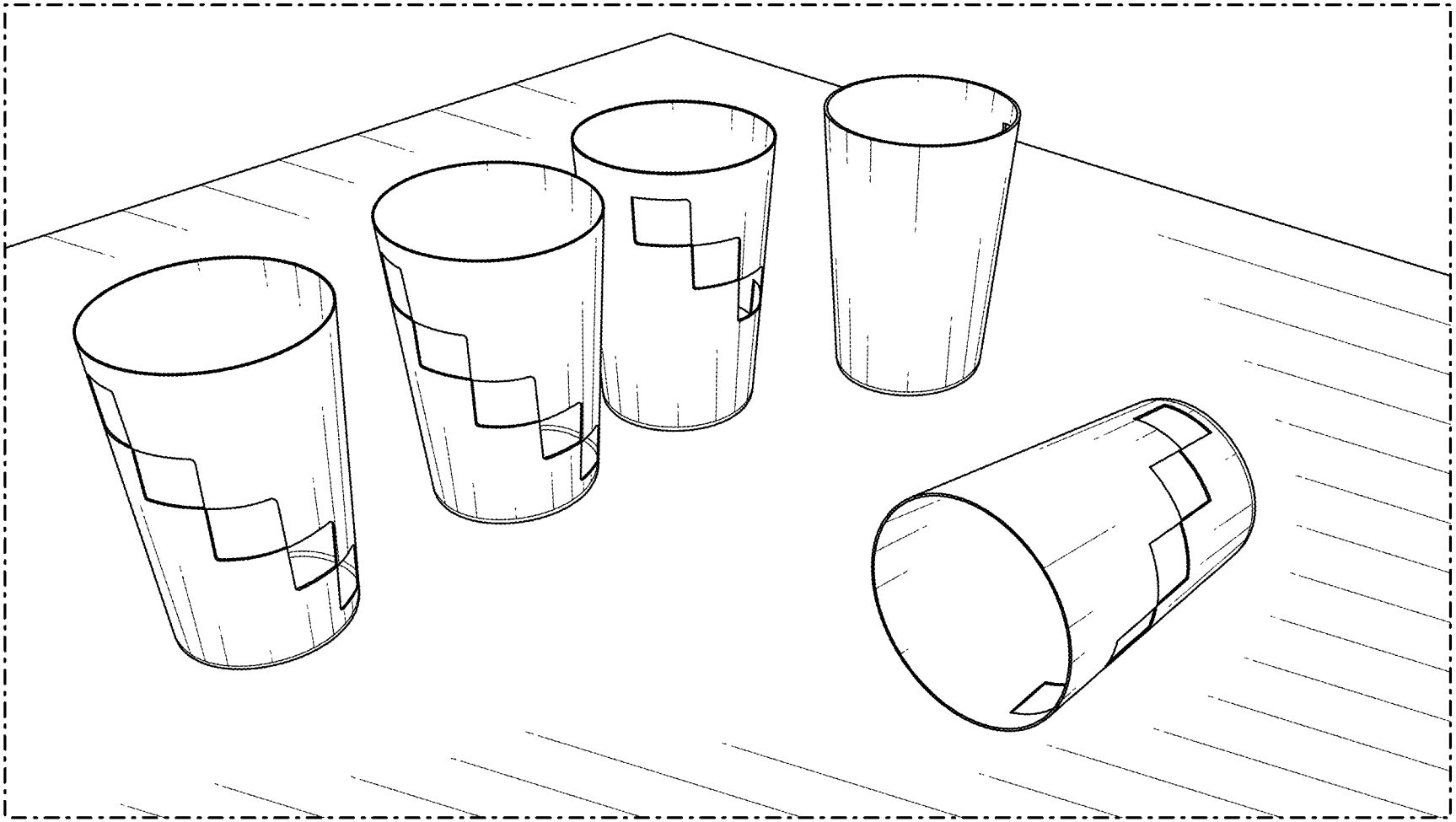
FIGS. 39-50 illustrate further implementations in accordance with the present disclosure.

With reference to FIG. 39, the inner cup/container can be placed within the outer shell cover (or the outer shell can be placed around the inner cup/container) and the user has the ability to rotate the outer shell cover horizontally. For example, the user can hold the inner cup/container at the top, while rotating the outer shell cover horizontally with their other hand. The user can move the outer shell cover from a position that, for example, completely covers the side openings of the inner cup/container to a position that partially or completely exposes the side openings and ultimately the comestible contents. This enables the user of the cup/container to control the size of the opening and protect the comestible items inside.

The outer shell cover can be made in various sizes. It can be the same size as the inner cup/container it is covering and the two containers can form a nested arrangement. Alternatively, the outer shell can be smaller in size than the container, covering a portion of the inner cup/container. The outer shell or cover can be positioned anywhere along the inner cup/container exterior, covering any part of the inner cup/container. The outer shell may have a top, or a bottom or both, as desired. The outer shell may alternatively have neither a top nor a bottom. In this embodiment the outer shell may be sleeve or belt shaped, and just cover a specific portion of the inner cup/container.

The outer shell/cover can range in designs and configurations. The outer shell can be made of an array of different materials. FIG. 39 illustrates a few illustrative examples of how the Outer Shell/Cover can be configured.

FIG. 39 shows the Outer Shell/Cover with a step down opening sequence. Side openings of the outer shell can be spaced sequentially in a step down pattern that has a plurality of openings spaced radially about the container, but at progressively lower or higher elevations. These openings can selectively align with openings in an inner container. The pattern of openings on the inner container can be the same as the outer container, but are preferably different. For example, the inner container can have an elongate vertical opening that aligns with the outer shell illustrated in FIG. 39 such that different elevations of the inner container can be accessed depending upon the relative rotational position of the outer shell and the inner container. Accordingly, the user can move/rotate the outer shell to access a lower open section of the underlying inner cup/container to access the contents. In addition to using their fingers, the users may also utilize eating utensils such as forks or chop sticks to access the comestible items that are held within the inner cup/container.

Figure 40:
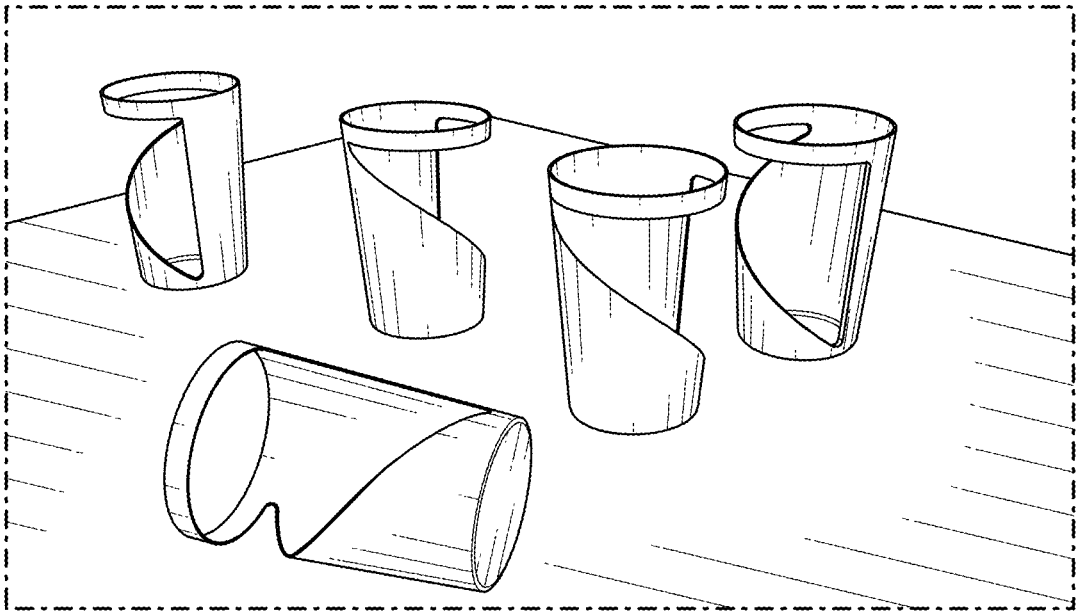
Figure 41:
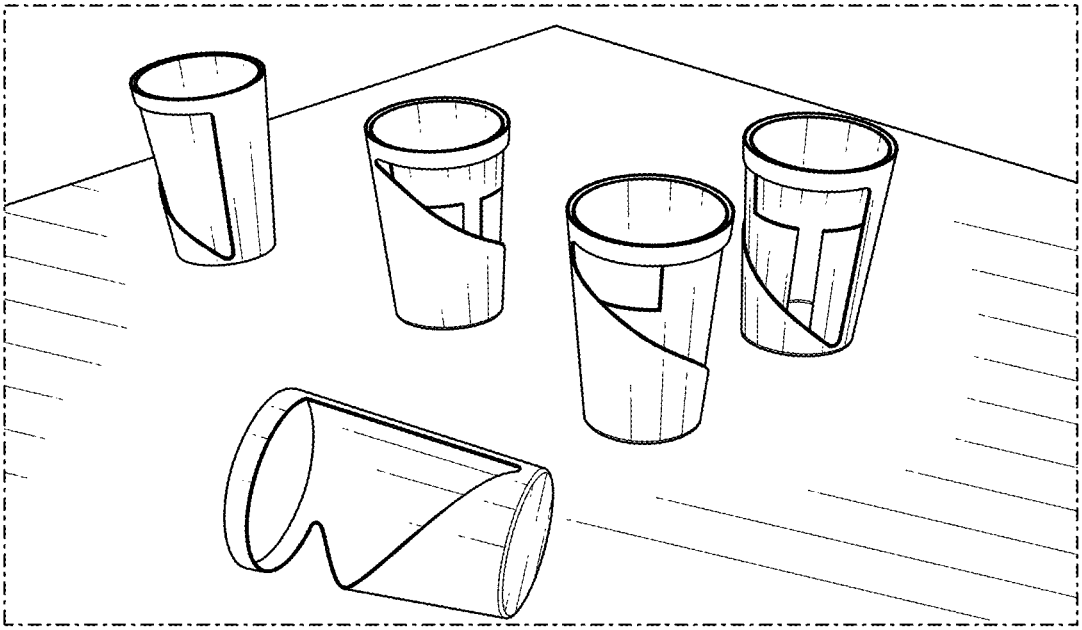

FIGS. 40 and 41 illustrate the outer shell or cover in a gradual configuration which allows the user to rotate the outer shell horizontally in a continuous fashion in order to create the desired side opening to access the comestible items. If rolled out flat, the side wall of the container can have a generally triangular shape, but it will be appreciated that this accounts for the conical shape of the shell if the shell is a conic section. The user has the ability to keep the interior items completely covered or have the items partially/completely exposed/accessible. FIG. 40 shows just the outer shell cover. This outer shell cover has a side opening that gradually expands horizontally. FIG. 41 shows the outer shell cover used along with the inner cup/container. The inner cup/container in this example is has a T-shaped opening, but it will be appreciated that the opening(s) of the inner container can have any desired shape and location.

Figure 42:
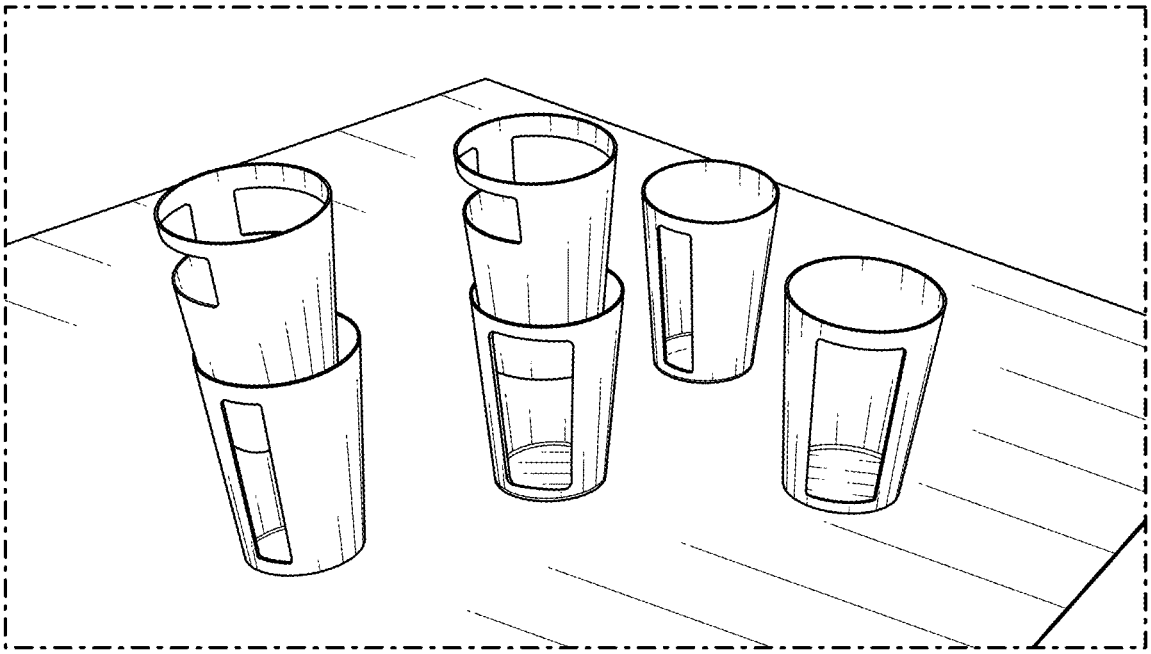

FIG. 42 shows an illustrative vertical opening configuration which allows the user to keep the interior items completely protected until the user rotates the outer shell horizontally in order to partially or completely expose the interior comestible items.

Figure 43:
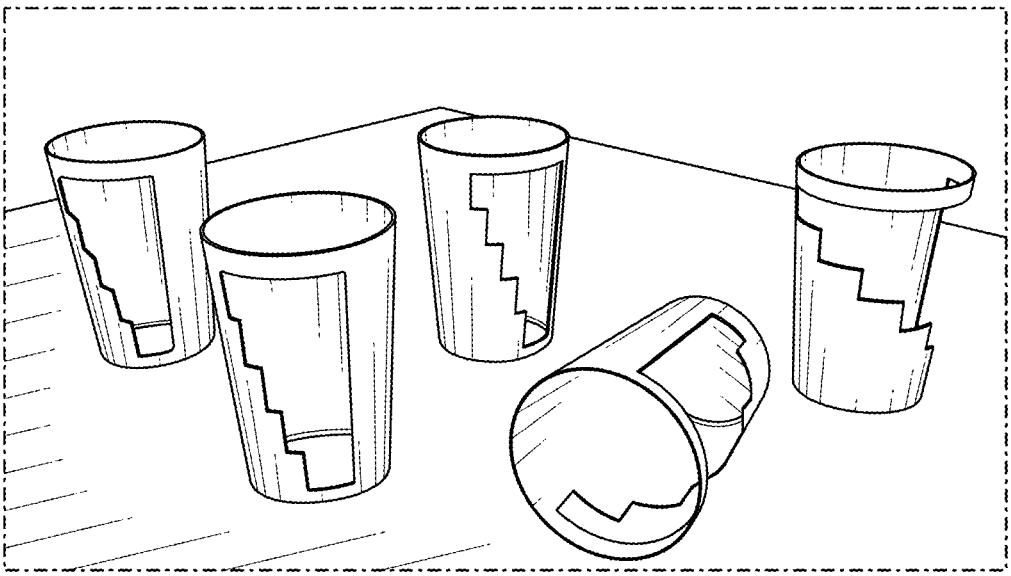
Figure 44:
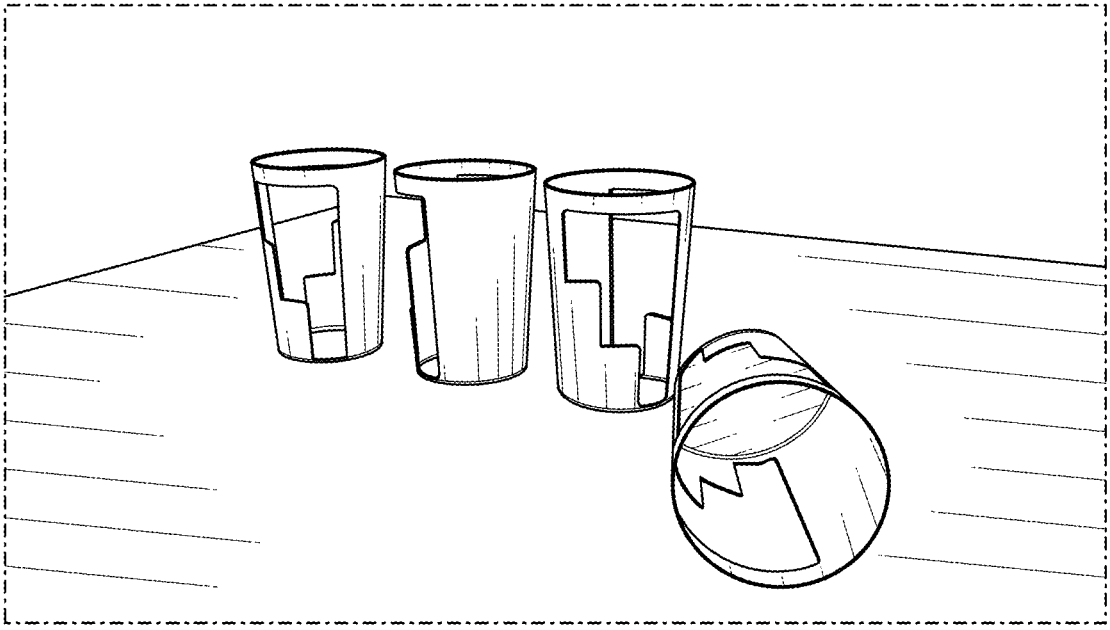

FIGS. 43-44 show additional illustrative step down configurations, wherein the opening has a first vertical side, a top and bottom connected to the first side, and a fourth side that steps down incrementally vertically and horizontally to form a plurality of steps. The perimeter can include straight and/or curved edges and may include sharp or rounded corners. Some of the depicted shells have bottom covers (i.e., sleeves) and other do not have bottom covers.

A container for holding comestible substances, comprising an outer container having a first uppermost peripheral edge at an upper end thereof and an inner contianer having a second uppermost peripheral edge at an upper end thereof, wherein the first uppermost peripheral edge is located proximate the second uppermost peripheral edge, wherein the inner container can rotate within and with respect to the outer container, wherein the inner container defines an inner container sidewall opening and the outer container defines a complementary outer container sidewall opening therethrough, wherein the inner container defines a bottommost wall coupled to the inner container sidewall, wherein the inner container defines a continuous inner compartment therein along its height from the bottommost wall to the second uppermost peripheral edge, the height of the inner compartment being greater than its width, and further wherein relative rotation of the outer container with respect to the inner container causes an overlap of the inner container sidewall opening and the outer container sidewall opening to selectively define an adjustable access opening through the sidewall of the outer container and inner container to permit a user to extract a comestible article from within the inner container through the adjustable access opening, wherein the inner container sidewall opening and the outer sidewall container opening each have a stepped peripheral edge.

Figure 45:
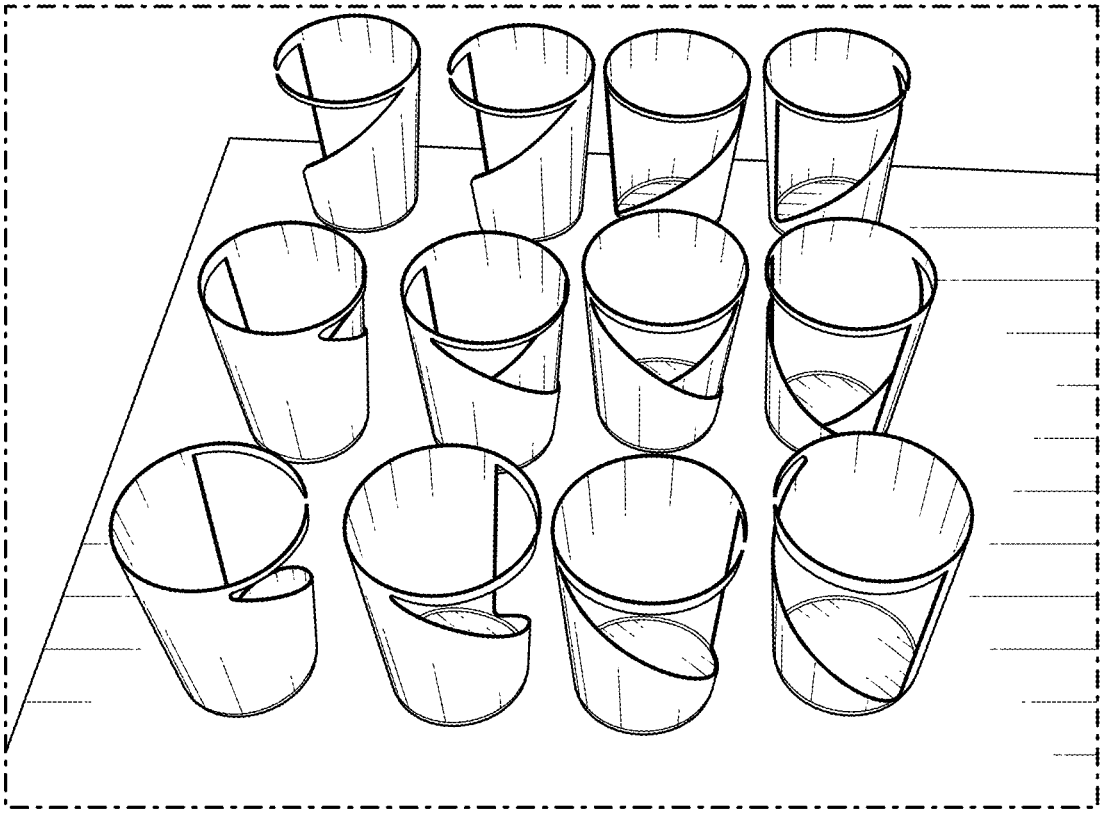

FIG. 45 illustrates embodiments having three horizontal rows of four cups/containers. The top row shows the inner cup/containers, the bottom row shows the outer shells and the middle row shows the inner cup/containers and outer shells being used together. The inner cup/containers have an opening that gradually increases going from left to right having a long vertical side on the right and a generally triangular opening. The outer shells have an opening that gradually increases as you go from right to left, such that the long vertical side is on the left. When these two objects are used together (as seen in the middle row), the size of the side opening can be controlled to form a progressively larger triangular opening that has a flat side at the top, but it can be configured oppositely wherein the triangle has a flat side at the bottom. The two objects can completely close off the inner contents or create an opening that ranges from narrow to substantially large. The user can control this simply by rotating the outer shell horizontally.

Each outer shell and inner cup/container combination (as seen in the middle row of FIG. 45) changes as you move from the combination on the left to each sequential combination to the right. The combination of the inner cup/container and the outer shell (all the way on the left) shows a closed configuration where the comestible items would not be accessible from the side. Each successive combination to its right shows how a turn of the outer shell can create a larger opening, ultimately allowing more access to the comestible items within.

Figure 46:
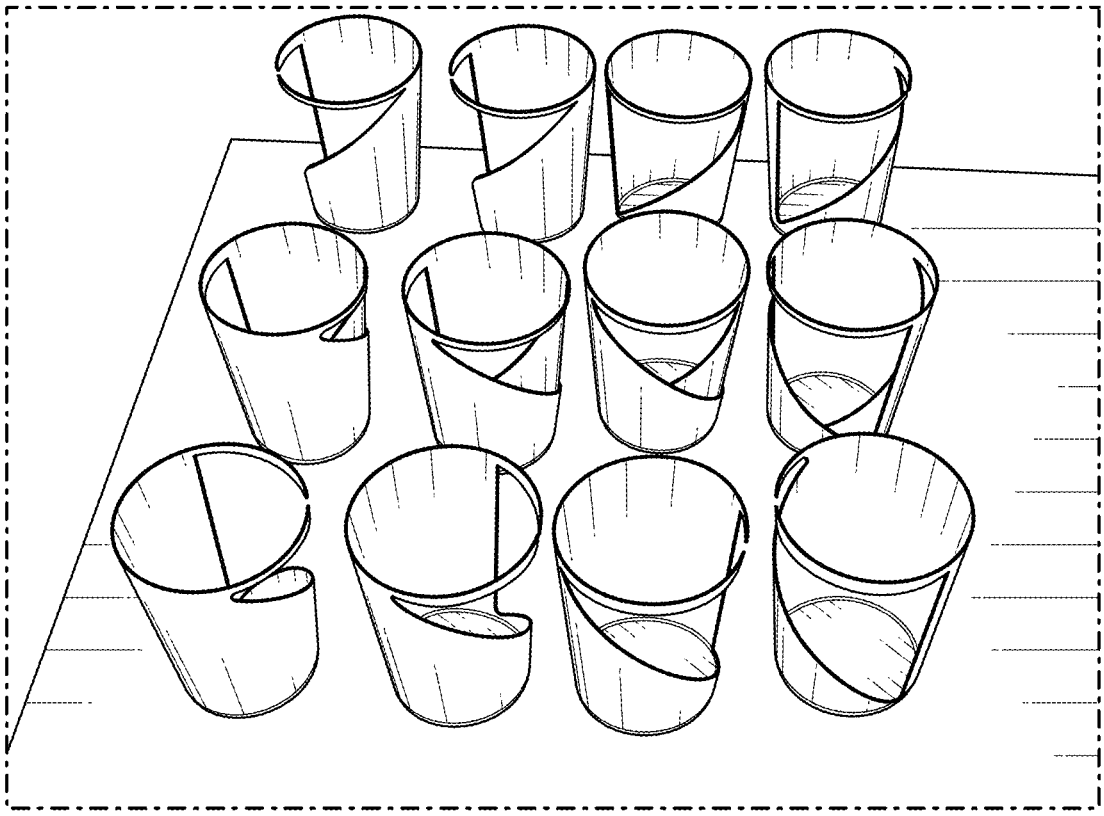

FIG. 46 illustrates implementations wherein the inner cup/container may be designed to extend higher vertically relative to the outer shell so the user may be able to hold the top of the inner cup/container with one hand while rotating the outer shell with the other hand. If this design is utilized, the container lid can be secured onto the inner cup/container.

Figure 47:
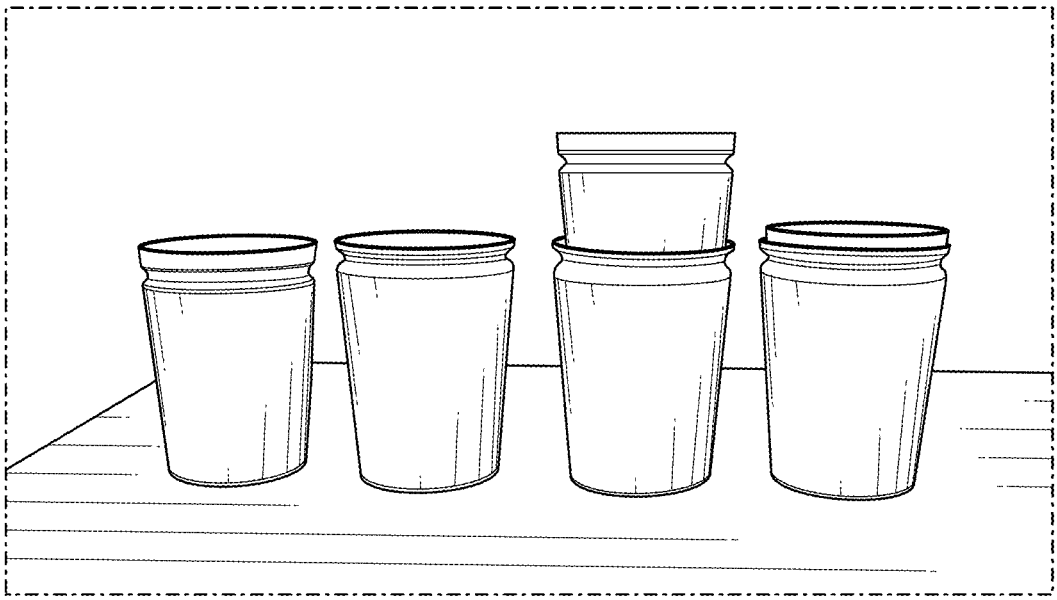

As seen in FIG. 47, the two objects (inner cup/container and outer shell) can in some circumstances be secured together utilizing a ridge/slot mechanism. Ultimately a horizontal ridge/slot that exists on the outer shell can "click-in" by a partial interference fit or be secured into/onto a horizontal ridge/slot that exists on the inner cup/container. This permits the two objects to be secured together and prevent the outer shell from falling down when the user is only holding the top portion of the inner cup/container. The user can secure the two objects by pushing the outer shell up to the point where its horizontal ridge is secured onto the outer ridge of the inner cup. The user can also secure the two objects by pushing the inner cup/container down to the point where its horizontal ridge is secured onto the outer ridge of the outer shell.

The user can also initiate separation of the two objects by using a downward pulling force on the outer shell (or upward pulling force on the inner cup/container), essentially pulling the two objects lose.

Figure 48:
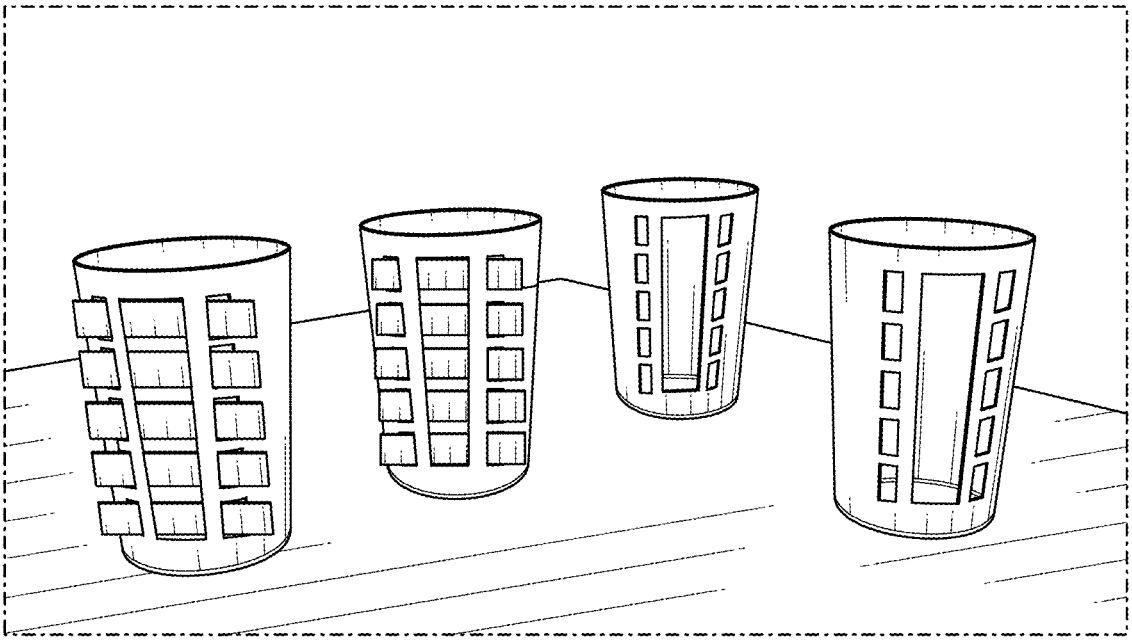

FIG. 48 illustrates outer shell cover—tab inserts being used to secure/cover the openings of the outer shell cover. This design can also be applied to the inner cup/container as well. The tab inserts can range in size and shape. Some outer shells or inner cup/containers can use one tab insert and others may use more than one tab insert. The tab inserts can also be configured vertically in addition to the horizontal configuration displayed in FIG. 48. The tab inserts can range in size and shape. The tabs can be made of an array of different materials. The tab inserts can also be configured on angles as well as horizontal and vertical placements.

Figure 49:
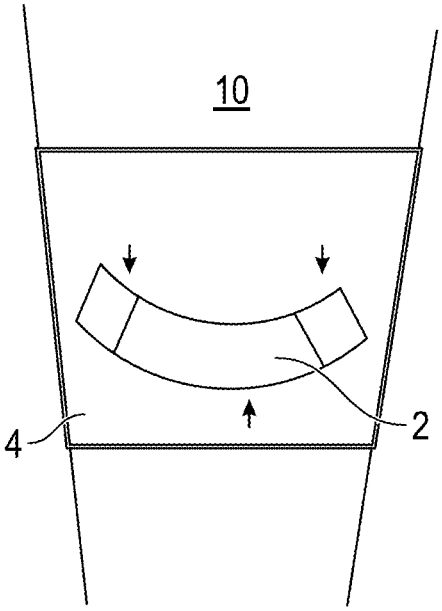
Figure 50:
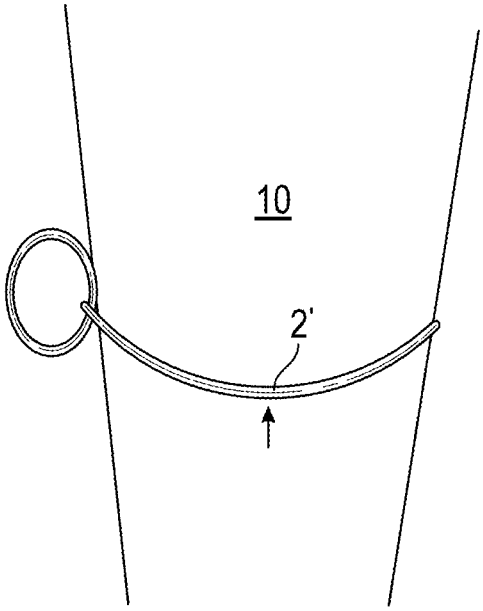

As illustrated in FIGS. 49-50, handles can be manufactured with the cup/container 10 system and/or added/attached on to the cup/container system. Handles 2, 2' may make carrying the cup/container easier for users. The handles can be made in various sizes and the handles can be located on or attached to various parts of the cup/container or the outer shell. The handles can be made in various shapes as well. More than one handle may be attached to any one cup/container or outer shell. Additionally, the handles may be made of many different types of materials. The handles that are added/attached on to the cup/container may be attached with adhesives, friction/tension or many other ways. One example of a friction/tension attachment for the handle is a loop or a sleeve 4 (such as a thermally insulative sleeve) that horizontally covers the side of the cup/container or outer shell. This loop or sleeve can have a handle attached, which ultimately makes it easier for the user to carry the entire cup/container system.

The outer shell may also be designed to extend higher vertically relative to the inner cup/container so the user may be able to hold the entire container at any location. The user can rotate the inner cup manually in order to increase the size of the side openings. If this design is utilized, the container lid can be secured onto the outer cup/outer shell.

The outer shells and inner cup/containers used together may have any array of side opening configurations. The shapes of the side openings can range from small to large and cover an array of different opening types. This permits many combinations of uses of the outer shells and inner cup/containers.

Although the present disclosure herein has been described with reference to particular preferred embodiments thereof, it is to be understood that these embodiments are merely illustrative of the principles and applications of the disclosure. Therefore, modifications may be made to these embodiments and other arrangements may be devised without departing from the spirit and scope of the disclosure.

What is claimed is:

1. A container for holding comestible substances, comprising an outer container having a first uppermost peripheral edge at an upper end thereof and an inner container having a second uppermost peripheral edge at an upper end thereof, wherein the first uppermost peripheral edge is located proximate the second uppermost peripheral edge, wherein the inner container can rotate within and with respect to the outer container, wherein the inner container defines an inner container sidewall opening and the outer container defines a complementary outer container sidewall opening therethrough, wherein the inner container defines a bottommost wall coupled to the inner container sidewall, wherein the inner container defines a continuous inner compartment therein along its height from the bottommost wall to the second uppermost peripheral edge, the height of the inner compartment being greater than its width, and further wherein relative rotation of the outer container with respect to the inner container causes an overlap of the inner container sidewall opening and the outer container sidewall opening to selectively define an adjustable access opening through the sidewall of the outer container and inner container to permit a user to extract a comestible article from within the inner container through the adjustable access opening, wherein the inner container sidewall opening and the outer container sidewall opening each have a stepped peripheral edge.

2. The container of claim 1, wherein the adjustable access opening is vertically oriented along the height of the container.

3. The container of claim 2, wherein the adjustable access opening is a first width at the bottom of the container and becomes relatively wider at the top of the container.

4. The container of claim 1, further comprising a lid with a depression formed in for containing a comestible product, and still further comprising a comestible product disposed in the depression.

5. The container of claim 1, further comprising a comestible product inserted into the inner container.

6. The container of claim 1, further comprising an elevation platform disposed within the inner container to elevate a comestible product within the inner container.

7. The container of claim 1, wherein the container further includes a removable covering disposed over the adjustable access opening.

8. The container of claim 1, wherein the outer container sidewall opening is defined at least in part by perforations formed in that are ruptured to create the access opening.

* * * * *